US010083567B2

(12) United States Patent
Hollibaugh et al.

(10) Patent No.: US 10,083,567 B2
(45) Date of Patent: Sep. 25, 2018

(54) DISCOUNTED WAGERING GAME DEVICES AND METHODS

(75) Inventors: Larry R. Hollibaugh, Reno, NV (US); Ronald P. Papson, Reno, NV (US)

(73) Assignee: IGT, Las Vegas, NV (US)

( * ) Notice: Subject to any disclaimer, the term of this patent is extended or adjusted under 35 U.S.C. 154(b) by 1397 days.

(21) Appl. No.: 12/266,427

(22) Filed: Nov. 6, 2008

(65) Prior Publication Data

US 2009/0131155 A1 May 21, 2009

Related U.S. Application Data

(60) Provisional application No. 60/987,343, filed on Nov. 12, 2007.

(51) Int. Cl.
*G07F 17/32* (2006.01)

(52) U.S. Cl.
CPC ..... *G07F 17/32* (2013.01); *G07F 17/3248* (2013.01); *G07F 17/3255* (2013.01)

(58) Field of Classification Search
CPC ..... G07F 17/3248; G07F 17/3255
USPC ..... 463/16–20, 25
See application file for complete search history.

(56) References Cited

U.S. PATENT DOCUMENTS 6,077,163 A 6/2000 Walker et al.
6,319,127 B1 11/2001 Walker et al.
6,800,027 B2 * 10/2004 Giobbi et al. ..... 463/24
7,140,964 B2 11/2006 Walker et al.
7,156,739 B2 1/2007 Walker et al.
7,591,726 B2 9/2009 Baerlocher et al.
7,862,416 B2 1/2011 Walker et al.
7,874,914 B2 1/2011 Walker et al.
7,892,092 B2 * 2/2011 Matthews et al. ..... 463/25
7,914,375 B2 3/2011 Walker et al.
7,934,990 B2 5/2011 Walker et al.
8,021,229 B2 9/2011 Walker et al.
8,277,309 B2 10/2012 Walker et al.
(Continued)

FOREIGN PATENT DOCUMENTS

WO WO 2003/089088 10/2003
WO WO 2005/099391 10/2005
WO WO 2005099391 A2 * 10/2005

OTHER PUBLICATIONS

PCT International Search Report and Written Opinion dated Feb. 12, 2009 issued in WO 2008/083022.
(Continued)

*Primary Examiner* — Jay Liddle
(74) *Attorney, Agent, or Firm* — Neal, Gerber & Eisenberg LLP

(57) ABSTRACT

Many implementations of the invention involve discounted wager gaming. Some such implementations involve discounted tickets, which may or may not be "guaranteed play" tickets valid for at least a predetermined number of plays of a wagering game. Some implementations associate a code, sometimes referred to as a Group ID code or the like, with one or more types of contracts for guaranteed play tickets. Other implementations of the invention involve determining a discounted ticket cost C and wagering game value V and determining a coin in amount for a wagering game according to a function of C and V. Still other implementations of the invention provide solutions to accounting challenges relating to discounted tickets.

22 Claims, 10 Drawing Sheets

(56) References Cited

U.S. PATENT DOCUMENTS

| | | | | |
|---|---|---|---|---|
| 2002/0143619 | A1 | 10/2002 | Laurie | |
| 2003/0003983 | A1 | 1/2003 | Walker et al. | |
| 2003/0032473 | A1 | 2/2003 | Rowe et al. | |
| 2004/0002379 | A1 | 1/2004 | Parrott et al. | |
| 2004/0224753 | A1* | 11/2004 | O'Donovan et al. | 463/20 |
| 2006/0035701 | A1 | 2/2006 | Walker et al. | |
| 2006/0079316 | A1* | 4/2006 | Flemming et al. | 463/25 |
| 2006/0105836 | A1 | 5/2006 | Walker et al. | |
| 2006/0111175 | A1 | 5/2006 | Walker et al. | |
| 2006/0211488 | A1* | 9/2006 | Walker et al. | 463/25 |
| 2006/0232003 | A1 | 10/2006 | Walker et al. | |
| 2006/0252514 | A1 | 11/2006 | Walker et al. | |
| 2007/0015568 | A1 | 1/2007 | Walker et al. | |
| 2007/0191094 | A1 | 8/2007 | Walker et al. | |
| 2007/0213132 | A1* | 9/2007 | Chilton et al. | 463/42 |
| 2007/0275777 | A1* | 11/2007 | Walker et al. | 463/16 |
| 2008/0026822 | A1* | 1/2008 | Walker et al. | 463/25 |
| 2008/0096650 | A1* | 4/2008 | Baerlocher | 463/30 |
| 2008/0113770 | A1* | 5/2008 | Gelber et al. | 463/25 |
| 2008/0182650 | A1 | 7/2008 | Randall et al. | |
| 2008/0274783 | A1 | 11/2008 | Walker et al. | |
| 2008/0274792 | A1 | 11/2008 | Walker et al. | |
| 2010/0240442 | A1* | 9/2010 | Anderson et al. | 463/24 |
| 2010/0331068 | A1 | 12/2010 | Walker et al. | |
| 2011/0014963 | A1 | 1/2011 | Walker et al. | |
| 2011/0117987 | A1* | 5/2011 | Aoki et al. | 463/20 |

OTHER PUBLICATIONS

PCT International Preliminary Report on Patentability and Written Opinion dated May 18, 2010 issued in WO 2008/083022.
Australian Examiner's First Report dated Aug. 16, 2012 issued in AU2008321173.

* cited by examiner

| Theme 205 | Denom 210 | Price 215 | Group ID 220 |
|---|---|---|---|
| All | Varies | $5 | ALL-5 |
| All | Varies | $10 | ALL-10 |
| All | Varies | $20 | ALL-20 |
| All | Varies | $40 | ALL-40 |
| All | Varies | $100 | ALL-100 |
| Poker | $0.25 | $20 | PKR-20 |
| Poker | $1.00 | $100 | PKR-100 |
| Single-Hand Poker | $0.25 | $20 | SHP-20 |
| Single-Hand Poker | $1.00 | $100 | SHP-100 |
| Multi-Hand Poker | $0.25 | $20 | MHP-20 |
| Multi-Hand Poker | $1.00 | $100 | MHP-100 |
| Slot | $0.01 | $5 | SLT-5 |
| Slot | Varies | $10 | SLT-10 |
| Slot | $0.25 | $20 | SLT-20 |
| Slot | $0.25 | $40 | SLT-40 |
| Bonus Poker | $0.25 | $20 | BP-20 |
| Bonus Poker | $1.00 | $100 | BP-100 |
| Bonus Poker | $0.25 | $1.25 | BP-125 |
| Deuces Wild | $0.25 | $20 | DW-20 |
| Deuces Wild | $1.00 | $100 | DW-100 |
| Deuces Wild | $0.25 | $1.25 | DW-125 |
| Texas Tea | $0.01 | $5 | TT-5 |
| Texas Tea | Varies | $10 | TT-10 |
| Texas Tea | $0.25 | $20 | TT-20 |
| Texas Tea | $0.25 | $40 | TT-40 |
| Texas Tea | $0.01 | $0.75 | TT-075 |
| Little Green Men | $0.01 | $5 | LGM-5 |
| Little Green Men | Varies | $10 | LGM-10 |
| Little Green Men | $0.25 | $20 | LGM-20 |
| Little Green Men | $0.25 | $40 | LGM-40 |
| Little Green Men | $0.01 | $0.75 | LGM-075 |

200

FIG. 2

| | Game 405 | Denom 410 | Price 415 | Hands 420 | Config 425 | Groups 430 |
|---|---|---|---|---|---|---|
| 435 | Bonus Poker GP25-1 | $0.25 | $20 | 100 | P0003671/G0 | ALL-20, PKR-20, SHP-20 |
| 440 | Bonus Poker GP25-1 | $0.25 | $20 | 125 | P0003672/G0 | ALL-20, PKR-20, SHP-20, BP-20 |
| | Bonus Poker GP100-1 | $1.00 | $100 | 150 | P0003671/G2 | ALL-100, PKR-100, SHP-100, BP-100 |
| | Bonus Poker GP100-1 | $1.00 | $100 | 175 | P0003672/G2 | ALL-100, PKR-100, SHP-100, BP-100 |
| 445 | Bonus Poker GPI25-1 | $0.25 | $1.25 | 15 | P0003671/G9 | BP-125 |
| | Deuces Wild GP25-1 | $0.25 | $20 | 100 | P0004096/G0 | ALL-20, PKR-20, SHP-20, DW-20 |
| | Deuces Wild GP25-1 | $0.25 | $20 | 100 | P0003686/G0 | ALL-20, PKR-20, SHP-20, DW-20 |
| | Deuces Wild GP100-1 | $1.00 | $100 | 150 | P0004096/G2 | ALL-100, PKR-100, SHP-100, DW-100 |
| | Deuces Wild GP100-1 | $1.00 | $100 | 150 | P0003686/G2 | ALL-100, PKR-100, SHP-100, DW-100 |
| 450 | Deuces Wild GP25-1 | $0.25 | $1.25 | 12 | P0004096/G9 | DW-125 |

400

*FIG. 4*

501

| Theme 505 | Denom 510 | Price 515 | Min Hands 520 | Group ID 525 |
|---|---|---|---|---|
| All | $0.25 | $20 | 100 | ALL-20 |
| All | $1.00 | $100 | 150 | ALL-100 |
| Poker | $0.25 | $20 | 100 | PKR-20 |
| Poker | $1.00 | $100 | 150 | PKR-100 |
| Single-Hand Poker | $0.25 | $20 | 100 | SHP-20 |
| Single-Hand Poker | $1.00 | $100 | 150 | SHP-100 |
| Bonus Poker | $0.25 | $20 | 125 | BP-20 |
| Bonus Poker | $1.00 | $100 | 175 | BP-100 |
| Bonus Poker | $0.25 | $1.25 | 15 | BP-125 |
| Deuces Wild | $0.25 | $20 | 100 | DW-20 |
| Deuces Wild | $1.00 | $100 | 150 | DW-100 |
| Deuces Wild | $0.25 | $1.25 | 12 | DW-125 |

500

*FIG. 5*

DISCOUNTED WAGERING GAME DEVICES AND METHODS

CROSS-REFERENCE TO RELATED APPLICATION

This application claims priority to U.S. Provisional Application No. 60/987,343, entitled "DISCOUNTED WAGERING GAME DEVICES AND METHODS" and filed on Nov. 12, 2007, which is hereby incorporated by reference for all purposes.

FIELD OF THE INVENTION

The present invention relates generally to wager gaming, particularly to the provision and use of discounted wager gaming tickets.

BACKGROUND OF THE INVENTION

In recent years, some casinos have begun to provide free or discounted tickets to selected patrons. (The term "casino" may be used herein to mean any type of gaming establishment.) Providing discounted wager gaming tickets involves various opportunities and challenges. It would be desirable to improve at least some of these prior art methods, devices and/or systems.

SUMMARY OF THE INVENTION

Many implementations of the invention involve discounted wager gaming. Some such implementations involve discounted tickets, which may or may not be "guaranteed play" tickets valid for at least a predetermined number of plays of a wagering game. Some implementations associate a code, sometimes referred to as a Group ID code or the like, with one or more types of contracts for guaranteed play tickets. Other implementations of the invention involve determining a discounted ticket cost C and wagering game value V and determining a coin in amount for a wagering game according to a function of C and V. Still other implementations of the invention provide solutions to accounting challenges relating to discounted tickets.

Some embodiments of the invention provide a wager gaming machine, comprising a ticket reader configured to read a ticket code of a ticket for wager gaming and a logic system. The logic system comprises at least one logic device, such as a processor, a programmable logic device, etc. The logic system may be configured to receive a group identification code that corresponds, at least in part, to the ticket code and determine whether the group identification code corresponds to at least one wagering game theme that can be enabled on the wager gaming machine.

In some implementations, the logic system may be configured to receive the group identification code from another device. The other device may be, e.g., a server or another device of a central system. The other device may return a group identification code corresponding to the ticket code. For example, the ticket code may comprise a validation number and the other device may return a group identification code corresponding to the validation number. In alternative implementations, the logic system may be configured to determine the group identification code directly from the ticket code. The ticket code may also correspond to a ticket price.

The logic system may sometimes determine that the group identification code corresponds to a plurality of wagering game themes that can be enabled on the wager gaming machine. The wager gaming machine may further comprise a display device and the logic system may be further configured to control the display device to present an indication of the plurality of wagering game themes. The wager gaming machine may further comprise wager gaming apparatus for providing wagering games and wagering game theme selection apparatus for receiving a wagering game theme selection indication. The logic system may be further configured to receive a wagering game theme selection indication from the wagering game theme selection apparatus and to control the wager gaming apparatus to provide a selected wagering game theme according to the wagering game theme selection indication.

The wager gaming machine may further comprise a player loyalty device reader. The logic system may be further configured to do the following: receive player loyalty account information from the player loyalty device reader; determine wagering game preferences associated with the player loyalty account information; and determine whether there is a match between at least one of the plurality of wagering game themes and the wagering game preferences. The logic system may be further configured to control a display device to present, when there is a match between at least one of the plurality of wagering game themes and the wagering game preferences, an indication of at least one matching wagering game theme.

The determining step may involve determining that the group identification code corresponds to a wagering game theme that can be enabled on the wager gaming machine. The logic system may controls the wager gaming apparatus to provide one or more wagering games according to the wagering game theme. The determining step may involve comprises determining whether the group identification code corresponds to a guaranteed play session involving a predetermined number of plays of a wagering game.

If the logic system determines that the group identification code corresponds to no wagering game theme that can be enabled on the wager gaming machine, the logic system may be further configured to control the ticket reader to reject the ticket. The wager gaming machine may further comprise apparatus for determining (at least in part) whether the ticket is a valid ticket.

The wager gaming machine may further comprise a memory having one or more data structures stored thereon. One such data structure may indicate enabled wagering games and corresponding group identification codes. The logic system may be further configured to determine whether the group identification code matches one of the corresponding group identification codes of the data structure.

The wager gaming machine may further comprise a network interface system comprising at least one network interface. When the logic system determines that the group identification code corresponds to no wagering game theme that is currently enabled on the wager gaming machine, the logic system may be further configured to obtain downloaded software, via the network interface system, for a wagering game theme corresponding to the group identification code.

Alternative implementations of the invention provide a method, comprising: receiving a ticket for wager gaming having a ticket code indicated thereon; reading the ticket code; ascertaining whether the ticket code corresponds to a group identification code; and determining, when the ticket code does correspond to a group identification code, whether the group identification code corresponds to at least one wagering game theme that can be enabled on a wager gaming machine.

The method may involve determining whether the ticket is a valid ticket. The method may involve determining that the group identification code and/or the ticket code correspond to a ticket price. The determining step may comprise determining whether the code corresponds to a guaranteed play session involving a predetermined number of plays of a wagering game.

The determining step may involve determining that the group identification code corresponds to a plurality of wagering game themes that can be enabled on the wager gaming machine. The method may further comprise presenting an indication of the plurality of wagering game themes. The method may further comprise: receiving a wagering game theme selection; and providing a selected wagering game theme according to the wagering game selection.

The determining step may comprise determining that the group identification code corresponds to a single wagering game theme that can be enabled on the wager gaming machine. If so, the method may further comprise providing at least one play of a wagering game according to the single wagering game theme.

The determining step may comprise determining that the group identification code corresponds to no wagering game theme that can be enabled on the wager gaming machine. If so, the method may further comprise ejecting the ticket.

If the determining step comprises determining that the group identification code corresponds to no wagering game theme that is currently enabled on the wager gaming machine, the method may further comprise enabling a wagering game theme that corresponds to the group identification code. The enabling step may involve receiving instructions and/or data from another device, e.g., receiving a command from another device or obtaining game theme software from another device.

Alternative embodiments of the invention provide an apparatus, comprising: a reader configured to read a ticket code of a ticket for wager gaming and a logic system comprising at least one logic device. The logic system may be configured to determine whether a group identification code associated with the ticket code corresponds to at least one wagering game that can be enabled on a wager gaming machine. The ticket code may also correspond to a ticket price.

The apparatus may further comprise apparatus for determining (at least in part) whether the ticket is a valid ticket. For example, the ticket code may comprise a validation number. The apparatus may transmit the validation number to another device (e.g., to a server) and receive validation information from the other device.

The apparatus may further comprising a memory having a data structure stored thereon, the data structure indicating enabled wagering games and corresponding group identification codes. The determining step may comprise determining whether the group identification code matches one of the corresponding group identification codes of the data structure.

The apparatus may further comprise a network interface system comprising at least one network interface. The determining step may comprises sending a query, via the network interface system, to another device comprising a memory having a data structure stored thereon, the data structure indicating wagering games that can be enabled on the wager gaming machine and corresponding group identification codes. The other device may also have a memory with a data structure that indicates ticket validation numbers and corresponding group identification codes.

Some embodiments of the invention provide a wager gaming machine, comprising: apparatus for receiving a ticket for wager gaming having a ticket code indicated thereon; apparatus for determining whether the ticket is a valid ticket; apparatus for reading the ticket code; apparatus for determining whether a group identification code associated with the ticket code corresponds to at least one wagering game theme that can be enabled on a wager gaming machine; and apparatus for providing a wagering game theme when it is determined that the group identification code corresponds to at least one wagering game theme that can be enabled on a wager gaming machine.

Some methods of the invention include these steps: receiving a discounted ticket for wager gaming; determining a discounted ticket cost C and a discounted ticket wagering game value V; and providing a wagering game according to the wagering game credits; and determining a coin in amount according to a function of C and V. Such methods may also involve displaying the wagering game value V to the player.

The wagering game value V may comprises credit for a number of plays P of a wagering game with a wager of W per play. The discounted ticket cost C may be less than P times W. The determining step may comprise adding a coin in amount per play of C/P. The determining step may comprise calculating a coin in amount per play as C/P plus any non-restricted credits wagered. Such non-restricted credits may comprise, for example, a player's wins during a wager gaming session Such non-restricted credits may also comprise non-restricted indicia of credit provided by the player (e.g., in the form of currency, a cashless device such as a cashless voucher, a coupon, a ticket, a card, a memory device, etc.)

The wagering game value V may comprise a monetary value greater than the discounted ticket cost C. The determining step may comprise adding a coin in amount per play of C/V. The determining step may comprise adding a coin in amount per play of C/V plus any non-restricted credits wagered.

Alternative wager gaming machines may comprise: a ticket reader configured to read a ticket code of a discounted ticket for wager gaming; a wagering game providing apparatus configured for providing at least one type of wagering game; and a logic system comprising at least one logic device. The logic system may be configured to do the following: determine a cost C and a wagering game value V of the discounted ticket corresponding to the ticket code; control the wagering game providing apparatus to provide a wagering game; and calculating a coin in amount according to a function of C and V.

The wager gaming machine may further comprise a display device. The logic system may be further configured to control the display device to indicate the wagering game value V.

The wagering game value V may comprise a number of plays P of a wagering game with a wager of W per play. The discounted ticket cost C may be less than P times W. The calculating step may comprise adding a coin in amount per play of C/P. The calculating step may comprise adding a coin in amount per play of C/P plus any non-restricted credits wagered.

The wagering game value V may comprise a monetary value greater than the discounted ticket cost C. The calculating step may comprise adding a coin in amount per play of C/V. The determining step may comprise adding a coin in amount per play of C/V plus any non-restricted credits wagered.

Another method of the invention comprises these steps: receiving a discounted ticket for wager gaming; determining a discounted ticket cost C and the discounted ticket's wagering game value V, wherein the wagering game value V comprises a number of plays P of a wagering game with a wager of W per play, and wherein the discounted ticket cost C is less than P times W; providing the wagering game; and adding a coin in amount comprising C/P per wagering game play.

The adding step may comprise adding a coin in amount comprising C/P plus any non-restricted credits wagered per wagering game play. The method may further involve determining a total player win T for the P plays of the wagering game and determining a casino win amount as C−T.

Another method of the invention includes these steps: receiving a discounted ticket for wager gaming; determining a discounted ticket cost C and the discounted ticket's wagering game value V, wherein the wagering game value V comprises a monetary value greater than the discounted ticket cost C; providing the wagering game; and adding a coin in amount comprising C/V per wagering game play.

The method may further comprise: determining a total player win T for a session of N plays of the wagering game; and determining a casino win amount for the session as (NC/V)−T. The adding step may comprise adding a coin in amount comprising C/V plus any non-restricted credits wagered per wagering game play.

Yet another wager gaming machine of the invention comprises: apparatus for receiving a discounted ticket for wager gaming; apparatus determine a discounted ticket cost C and the discounted ticket's wagering game value V, wherein the wagering game value V comprises a monetary value greater than the discounted ticket cost C; apparatus for providing the wagering game; and apparatus for adding a coin in amount per play of the wagering game as C/V plus any non-restricted credits wagered. The wager gaming machine may further comprise: apparatus for determining a total player win T for a session of N plays of the wagering game; and apparatus for determining a casino win amount for the session as (NC/V)−T.

In still other implementations, data relating to discounted wagering games may not need to be embodied in ticket or another such physical medium, but may be, e.g., stored in a database and accessed when the player is playing a wagering game. For example, such data may be associated with a player's player loyalty account when a player purchases or otherwise receives credits for discounted wager gaming. The credits may be provided when the player's player loyalty instrument is detected, e.g., when the player inserts a player loyalty card into a wager gaming machine.

Various methods of the invention may be implemented, for example, by one or more logic devices executing software, implementing firmware, etc. Depending on the implementation, the logic device(s) may, for example, be disposed in a wager gaming machine, a host device, a server, a bill validator, a ticket reader and/or printer, or another device.

BRIEF DESCRIPTION OF THE DRAWINGS

FIG. 2 is a table that depicts one example of a data structure that may be used to implement, at least in part, some methods of the invention.

FIG. 4 is a table that depicts another example of a data structure that may be used to implement, at least in part, some methods of the invention.

FIG. 5 is a table that depicts yet another example of a data structure that may be used to implement, at least in part, some methods of the invention.

EXAMPLE EMBODIMENTS

Figure 1:
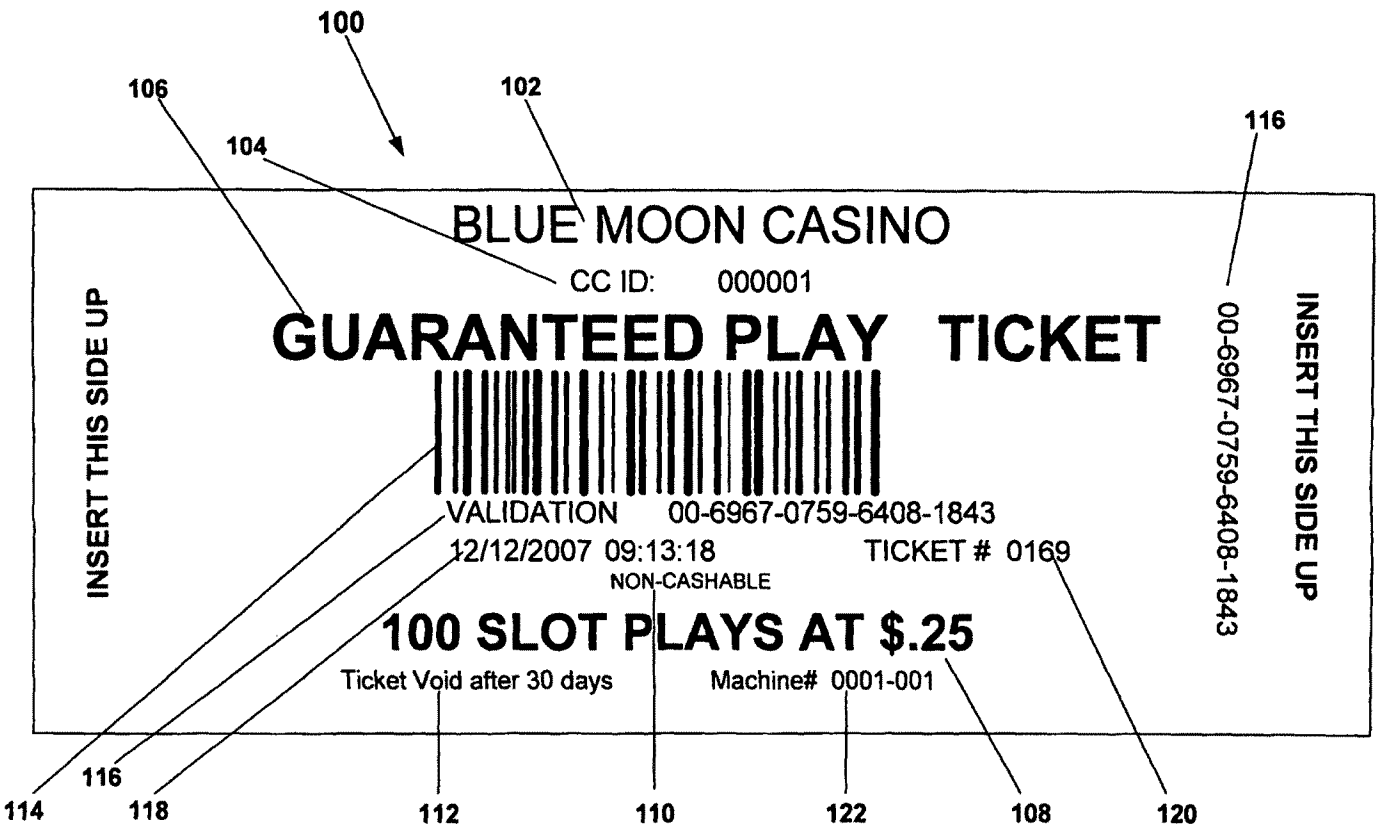
FIG. 1 provides an example of a discounted ticket for wager gaming that may be used to implement, at least in part, some methods of the invention.

In this application, numerous specific details are set forth in order to provide a thorough understanding of the present invention. However, the present invention may be practiced without some or all of these specific details. In other instances, well known process steps have not been described in detail in order not to obscure the present invention.

Reference will now be made in detail to some specific examples of the invention, including the best modes contemplated by the inventor for carrying out the invention. Examples of these specific embodiments are illustrated in the accompanying drawings. While the invention is described in conjunction with these specific embodiments, it will be understood that it is not intended to limit the invention to the described embodiments. On the contrary, it is intended to cover alternatives, modifications, and equivalents as may be included within the spirit and scope of the invention as defined by the appended claims.

Various techniques and mechanisms of the present invention will sometimes be described in singular form for clarity. However, it should be noted that some embodiments include multiple iterations of a technique or multiple instantiations of a mechanism unless noted otherwise. For example, a system may use a logic device, such as a processor, in a variety of contexts. However, it will be appreciated that a system can use multiple logic devices for similar purposes, while remaining within the scope of the present invention.

Furthermore, the techniques and mechanisms of the present invention will sometimes describe and/or illustrate a connection between two entities. It should be noted that a connection between two entities does not necessarily mean a direct, unimpeded connection, as a variety of other entities may reside between the two entities. For example, a processor may be connected to memory, but it will be appreciated that a variety of bridges and controllers may reside between the processor and memory. Consequently, an indicated connection does not necessarily mean a direct, unimpeded connection unless otherwise noted. Moreover, there may be other connections between entities than are indicated herein, e.g., in network diagrams.

Many implementations of the invention involve discounted wager gaming. Some such implementations involve discounted tickets, such as "guaranteed play" tickets. Guaranteed play tickets are preferably valid for at least a predetermined number of plays of a wagering game. The predetermined number of plays may, e.g., be provided for a discounted cost as compared to the value of the ticket when used for wager gaming. For example, the predetermined number of plays may be provided for a discounted cost as compared to the predetermined number of plays multiplied by a predetermined wager amount per play. However, other discounted wager gaming tickets (and the like) are described herein. Some such discounted tickets may not involve a predetermined number of plays of a wagering game.

Other implementations of the invention provide solutions to accounting challenges relating to discounted tickets. For example, a casino needs to account accurately for the cost of a discounted ticket, a player's wins or losses when using such a ticket, etc. As noted above, the casino's "cost" may differ from the discounted ticket's value in terms of wagering game credits. In some implementations, the cost will be used as a reference in determining "coin in," wins, losses, etc. This cost may be, for example, what a patron has actually paid for a discounted ticket or may be a cost assigned by the casino. The latter case may apply, e.g., when the discounted ticket was provided as part of a package.

Discounted Wager Gaming

Some aspects of the invention involve discounted wager gaming, which may involve discounted tickets. An example of a discounted ticket is provided in FIG. 1.

FIG. 1 presents a specific example showing some components of a discount ticket 100. In other implementations, a discounted ticket may be embodied in other forms, e.g., as a card, a token, etc. Moreover, the particular types of information, layout, etc., shown in FIG. 1 are merely illustrative.

Ticket 100 may be, e.g., a paper or plastic ticket having various types of information printed thereon. In one embodiment, the format of the ticket 100 may be generated from a template stored within a printer (e.g., a thermal printer). The printing templates allow parameter values sent from a logic device such as a master gaming controller of a wager gaming machine, another logic device of a gaming machine or other gaming device, kiosk, ticket dispenser, server, etc. to be printed in a particular format.

In this example, various parameter values are indicated on the ticket, some of which are readable by a human and some of which are not. Here, the name of a gaming establishment is indicated in area 102 and a gaming establishment identification code is indicated in area 104. In some implementations, the gaming establishment may be identified according to location information (e.g., by address information such as a street address, city, state and/or zip code).

Area 106 indicates the type of discounted ticket, which is "guaranteed play" in this example. Guaranteed play ("GP") tickets may be valid for at least a predetermined number of plays of a wagering game. In this example, ticket 100 entitles a player to 100 slot plays having a wager of $0.25 per play. (See area 108.) As described elsewhere herein, the indicated number of guaranteed plays may be a minimum. For example, some wager gaming machines may be configured to provide more than 100 slot plays when ticket 100 is used in a wager gaming machine.

The predetermined number of plays of a GP ticket may, e.g., be provided for a discounted cost as compared to the value of the ticket when used for wager gaming. For example, the predetermined number of plays may be provided for a discounted cost as compared to the predetermined number of plays multiplied by a predetermined wager amount per play.

However, other discounted wager gaming tickets (and the like) are described herein. Some such discounted tickets may not involve a predetermined number of plays of a wagering game. A discounted ticket may, for example, be provided for a cost that is less than the value of the discounted ticket measured in terms of the amount of credit that may be used for wager gaming. However, a patron may be able to, e.g., select a wager level and/or other features during wager gaming.

Similarly, whereas much of the description herein pertains to the use of discounted tickets with wager gaming machines, the present invention is not so limited. Instead, the present invention applies broadly to discounted wager gaming, including but not limited to "guaranteed play" wager gaming of many types, including wager gaming provided by automated table games. Some such examples are described in U.S. Provisional Patent Application No. 60/986,507, entitled "Automated Techniques for Table Game State Tracking" and filed on Nov. 8, 2007 and in U.S. Provisional Patent Application No. 61/002,576, entitled "Intelligent Stand Alone Multiplayer Gaming Table with Electronic Display" and filed on Nov. 9, 2007, U.S. patent application Ser. No. 11/938,179, by Wells et al., entitled "TRANSPARENT CARD DISPLAY," filed on Nov. 9, 2007 and U.S. Provisional Patent Application Ser. No. 60/987,276, by Wells et al., entitled "Intelligent Stand Alone Multiplayer Gaming Table With Electronic Display," filed on Nov. 12, 2007, all of which are hereby incorporated by reference.

Depending on the implementation and/or a casino's use of discounted tickets, the predetermined number of plays of a GP ticket may be provided for a discounted cost as compared to the value of the ticket when used for wager gaming, may be provided at no cost, etc. However, it will often be the case that the use of a discounted ticket will be restricted in some fashion. In this example, ticket 100 is a "non-cashable" ticket. In other words, the ticket is not directly redeemable for cash, e.g., at a wager gaming machine. (See area 110.) Here, the ticket is only valid for 30 days after issuance (see area 112) and is only valid at a particular casino. (See area 102.)

Other restrictions may apply. In some implementations, a discounted ticket may not be transferable. In other words, the discounted ticket may only be legitimately used by a particular person. According to some such implementations, information regarding that person may be encoded on the ticket and/or associated with the ticket. In some such implementations, a player may need to use a player loyalty card (or the like) or otherwise provide some authentication and/or identification information at the time of wager gaming in order to use a discounted ticket. For example, the ticket validation process may involve determining whether the player seeking to use the discounted ticket is the same player to whom the discounted ticket was issued.

In this embodiment, ticket 100 includes a bar code 114, which may indicate various types of information in a machine-readable format. For example, bar code 114 may indicate ticket validation code 116, issue date and issue time 118, ticket number 120, ticket value 114, ticket restriction data (such as non-cashable status, expiration date/time, geographic limits, player identification data, etc.), dispensing machine number 122, and/or other information. In some implementations, however, bar code 114 may indicate only a relatively small amount of information, e.g., only ticket validation number 116.

Note that machine-readable information may be provided in a format other than a bar code. For example, some tickets (or the like) may include a radio frequency identification ("RFID") tag or other transponder device, a magnetic strip, etc., having such information encoded thereon. If a bar code is used, the bar code need not be the one-dimensional form of bar code depicted in FIG. 1, but may be, e.g., a 2-dimensional bar code.

In some preferred implementations of the invention, ticket 100 (or the like) will indicate "Group ID" information, which is described in detail below. Preferably, this information is indicated in machine-readable form. However, in other implementations, Group ID information, ticket price information, and/or other information may be determined by mapping information from the ticket to corresponding information stored in a data structure. In some such implementations, for example, Group ID information and/or ticket price information may be determined by another device (e.g., from a server, a host device, a kiosk, etc.) based upon a validation code read from the ticket and transmitted to the other device. The other device may query a database to determine whether the validation code corresponds with a Group ID, with a ticket cost, etc. If so, the other device will provide the information to the EGM.

One such data structure will now be described with reference to FIG. 2. Data structure 200 indicates various fields of information that are relevant to various types of discounted tickets. These types will sometimes be referred to herein as "contracts," because they generally involve a particular offer for discounted play that a person may accept (e.g., by purchasing a ticket), thereby forming a contract. Data structure 200 may, for example, be stored in a storage device accessible by various devices in a gaming network, such as one or more servers, kiosks, host devices, EGMs, etc.

It will be appreciated that in practice, data structures having more or fewer fields, entries of fields, etc., may be used to implement various aspects of the invention. Some such data structures are described herein. In this example, contracts are provided in a hierarchical structure of themes, with variations at different hierarchical levels. Other implementations may or may not involve a hierarchical structure of themes.

Here, data structure 200 includes theme field 205, denomination field 210, price field 215 and Group ID field 220. As noted in theme field 205, some contracts ("All") apply to all types of wagering game play, whereas other contracts are more restricted. Some contracts apply to a general category of wagering games, such as poker games ("Poker") or slot games ("Slot"). Within each general category of wagering games, there may be one or more subcategories. Here, for example, there are subcategories for Single-Hand Poker and Multi-Hand Poker.

Each of these categories or subcategories may be subdivided according to game theme. In this example, the game themes of Texas Tea™ and Little Green Men™ are instances of the general "Slot" category of wagering games.

In this example, each type of contract may have a fixed denomination or a variable denomination. Here, for example, each of the "All" contracts have a variable denomination, whereas other contracts (e.g., the "Poker," "Bonus Poker™" and Deuces Wild™" contracts) have fixed denominations. A Texas Tea™ contract or a Little Green Men™ contract may be made with a fixed denomination or a variable denomination.

As with other aspects of the inventions described herein, these denomination examples are made only by way of illustration. There is no particular reason, for example, that Poker contracts could not be made with a fixed denomination. Moreover, a greater or smaller range of denominations may be used, according to the desired implementation.

In this example, price field 215 indicates the retail price of each type of contract. In some preferred implementations, each type of contract has the same retail price. The retail price may be the price that a player would be charged at an EGM to play the contract using cash. However, a contract may not be provided at the retail price. For example, a casino may sell a contract for a price below the retail price, or even give a discounted ticket away for free.

Group ID field 220 indicates the Group ID code that corresponds to each contract. In this example, each Group ID is depicted in human-readable form and indicates information from theme field 205 (e.g., "ALL") and price field 215 (e.g., "5"). Denomination information may be determined by association with the Group ID code, e.g., by reference to a data structure that indicates Group IDs and corresponding denomination information (such as data structure 200). However, in other implementations, a Group ID code may include denomination information and/or other information. Moreover, a Group ID code may or may not be presented in a form that a person could readily determine as having theme, denomination and/or price information. For example, instead of "ALL-5," the Group ID for the same contract could be "N18T49J."

Some examples of how discounted tickets (or the like) may be used will now be described with reference to flowchart 300 of FIG. 3. It will be appreciated that the steps indicated in flow chart 300 (as with other methods shown and described herein) are not necessarily performed in the order indicated. It should also be understood that the methods of the invention may include more or fewer steps than are indicated. For example, there may be other steps involved in the process that are not indicated in FIG. 3.

In step 305, a ticket is read by some type of ticket reader associated with an electronic wager gaming machine ("EGM"). The reader may be part of the EGM or may be a separate device, e.g., a reader that is shared by multiple EGMs, table games, etc. Examples of some such EGMs and other devices of gaming networks are described in detail below. The reader reads information that is encoded on the ticket, e.g., via a bar code, an RFID tag, a magnetic strip, etc.

The encoded information preferably includes some form of validation information that may be used to determine whether the ticket is valid, whether the ticket has previously been used, etc. Some such validation information is sent to one or more devices of a central system (step 310). The validation information may include a ticket validation number, e.g., as described above, but may also include other information regarding the discounted ticket. In this example, the reader sends the validation information to a server that has been configured to perform validation functions. Examples of processes performed by such a device are provided below.

In step 315, a validation message is received from the server. This information is processed in step 320. If the validation message indicates that the ticket is not valid, the ticket is returned to the player. (Step 355.) However, if the validation message indicates that the ticket is valid, processing of the ticket will continue.

Here, the EGM then determines whether the ticket is a discounted ticket. (Step 325.) In alternative implementations, another device (such as a server, a host device, a kiosk, etc.) may determine whether the ticket is a discounted ticket. In this example, the EGM determines whether the ticket is a discounted ticket according to whether the ticket indicates a code, such as a "Group ID" code or the like.

If the ticket is valid but does not have a Group ID, it will be treated as a normal ticket. The ticket will be stacked, credits will be added to the EGM's ticket in and credit meters, and wagering games will be provided according to input received from a player. (Step 330.)

However, if it is determined in step 325 that the ticket does have a Group ID, it will then be determined whether any matching games are currently enabled on the EGM. In this implementation, if the ticket has a Group ID but no matching games are currently enabled on the EGM, the ticket will be returned to the player. (Step 355.)

FIG. 4 depicts data structure 400, which is one example of a data structure that may be used, e.g., in making the determinations of steps 335 and 340. Data structures such as data structure 400 will sometimes be referred to as a "base program paytable cover sheet" or the like. Here, data structure 400 (or the like) may be stored, for example, in a memory of an EGM. As with other data structures described herein, it will be appreciated that a data structure having more or fewer fields, entries of fields, etc., may be used in making the determination of step 325 and/or to implement various other aspects of the invention.

In this example, data structure 400 includes game field 405, denomination field 410, price field 415, hands/plays field 420, configuration field 425 and group IDs field 430. Here, a group IDs will be included in field 430 for a particular instance of a game only if the minimum requirements of a corresponding contract are met. However, in some implementations, as here, there may be two or more configurations for a particular combination of game, denomination and price that meet the minimum requirements of contracts corresponding to the Group IDs indicated in field 430.

In one such example depicted in FIG. 4, a comparison of rows 435 and 440 reveals that the configuration information for Bonus Poker GP25-1 differs between rows 435 and 440. If configuration P0003671/G0 is enabled, the EGM will provide 100 hands of Bonus Poker GP25-1 for valid tickets indicating a Group ID of ALL-20, PKR-20 or SHP-20. However, if configuration P0003672/G0 is enabled, the EGM will provide 100 hands of Bonus Poker GP25-1 for tickets indicating a Group ID of ALL-20, PKR-20, SHP-20 or BP-20.

Data structure 500 of FIG. 5 (or the like) will sometimes be referred to herein as a "base program contract cover sheet" and may be stored, for example, in a memory of the EGM. Data structure 500 sets forth the parameters of contracts corresponding to the Group IDs referenced in FIG. 4, as implemented on a particular EGM. Referring to row 501, for example, the Group ID ALL-20 (see field 525) applies to all themes (see field 505) and has a price of $20 (see field 515). With regard to this particular EGM, the ALL-20 Group ID corresponds to wagering games at $0.25 denomination (see field 510). Discounted tickets indicating the ALL-20 Group ID will provide at least 100 hands or plays (see field 520).

A comparison of the relevant portions of data structure 500 with row 435 of FIG. 4 indicates that configuration P0003671/G0 of Bonus Poker GP25-1 satisfies the requirements of the contracts corresponding to the ALL-20, PKR-20 and SHP-20 Group IDs. However, configuration P0003671/G0 of Bonus Poker GP25-1 does not satisfy the requirements of the contract corresponding to Group ID BP-20: contracts having Group ID BP-20 must provide at least 125 hands or plays. On the other hand, configuration P0003672/G0 of Bonus Poker GP25-1 does satisfy the requirements of Group ID BP-20, because it provides 125 hands. Therefore, BP-20 is associated with configuration P0003672/G0, but not with configuration P0003671/G0.

In some implementations of the invention, the Group IDs for each configuration are constrained to be the same. According to such implementations, for example, each configuration of Bonus Poker GP25-1 would be enabled for all of Group IDs ALL-20, PKR-20, SHP-20 and BP-20. Because Group ID BP-20 requires a minimum of 125 hands, each such configuration would provide at least 125 hands.

Referring again to FIG. 3, according to this implementation, if it is determined that a valid ticket has a Group ID (step 325) but it is determined that no matching games are currently enabled on the EGM (step 335), the ticket will be returned to the player. (Step 355.) For example, if configuration P0003671/G0 were enabled and a valid ticket had a Group ID of BP-20, it would be determined in step 335 that no matching games are enabled. The ticket would be returned to the player. (Step 355.)

In alternative implementations, the EGM may be reconfigured to provide wagering games even if no matching games are currently enabled on the EGM. For example, if no matching games are currently enabled on the EGM, the EGM may be reconfigured (e.g., according to instructions from a server or another device of a gaming network) to provide a matching game.

In some such implementations, the EGM may be reconfigured if a player is a member of a casino's player loyalty system and has attained a predetermined level, e.g., a platinum level. In one such example, if a player's player loyalty status is at or above the predetermined level and the EGM is configurable for use with a valid ticket for which no matching games are currently enabled on the EGM, the EGM may be reconfigured accordingly.

Suppose, for example, that an EGM, a player loyalty server, or another such device determines that a player is at the predetermined level (e.g., the platinum level). Suppose also that it were determined that the player had provided a valid ticket having a Group ID of BP-20, but that configuration P0003671/G0 was currently enabled on the EGM. In one such implementation, the EGM would be (at least temporarily) re-configured to enable configuration P0003672/G0. A logic device of the EGM, of a server, etc., could cause the EGM to be re-configured in this fashion. Enabling configuration P0003672/G0 would provide an enhanced benefit to the player by allowing the player to use the discounted ticket at that particular EGM.

However, it may be generally desirable to have some predetermined EGMs of a casino that are configured for use with particular discounted tickets and some EGMs that that are not so configured. For example, a casino may identify particular areas of a casino that have relatively heavy use and others that have relatively lighter use. The usage levels may be caused by various factors, including the traffic patterns in a casino, nearby attractions, the relative popularity of game themes enabled on EGMs, etc. In some implementations, a casino operator may determine such usage patterns according to IGT Advantage™ systems, e.g., according to a Visual Slot Performance™ tool.

A casino operator may choose to configure relatively lower-usage EGMs for use with particular discounted tickets, but not higher-usage EGMs. One type of discounted ticket that may be used in such a fashion (or may be used otherwise, according to the implementation) will sometimes be referred to herein as an "invisible" contract or the like.

Referring again to FIG. 3, in step 340 it is determined whether the discounted ticket indicates an invisible contract. If the discounted ticket indicates a Group ID of BP-125, the EGM will determine whether configuration P0003671/G9 has been enabled in this example. (See row 445 of FIG. 4.) If so, the EGM will provide 15 hands of Bonus Poker at $0.25 denomination. (Step 360.) Similarly, if the discounted ticket indicates a Group ID of DW-125, the EGM will determine whether configuration P0004096/G9 has been enabled in this example. (See row 450 of FIG. 4.) If so, the EGM will provide 12 hands of Deuces Wild at $0.25 denomination.

For example, a casino employee may give a casino patron a ticket that indicates an invisible contract and direct the patron to a particular EGM, bank of EGMs, etc., configured to provide wagering games for the invisible contract. Although in this example the invisible contracts have a nominal price of $1.25, an invisible contract may be provided free of charge, for a nominal fee, as a bonus or other incentive, as part of a package, etc., according to the determination of the casino.

In this implementation, such "invisible" games are not presented to the player on a menu. Otherwise, however, if a valid ticket indicates a Group ID that corresponds to one or more wagering games, a menu indicating the game(s) will be presented, e.g., on a video display associated with the wager gaming machine. (Step 345.) In this example, if a discounted ticket indicates a Group ID of ALL-100, the player would be presented a menu that includes dollar-denominated Bonus Poker™ and Deuces Wild™ wagering games. The menu preferably indicates the number of plays/hands that correspond with the enabled configuration.

In some implementations, the menu may be configured according to player preferences, e.g., as determined from a database associated with a player loyalty program. Such implementations may be particularly desirable when a wager gaming machine is configured (or readily configurable, e.g., via downloading) to provide a relatively large number of wagering games and wherein the discounted ticket could be used for a substantial number of such games.

In order to give the player a reasonable amount of time to select a game, some existing types of bill validator firmware may need to be modified. Otherwise, for example, some existing bill validator firmware will end a transaction if the player took more than 30 seconds make this decision. In some such implementations, legacy bill validator firmware will be modified to add a "refresh timeout" command. Each time the EGM issues this command, the bill validator will restart its timer. In this way, the EGM can hold the discounted ticket for a longer period of time. It is anticipated that a timeout will be instituted that will reject the ticket and return to normal menus if there is no player action for a predetermined time, e.g., for a minute or two. This feature allows a player time to look at paytables being offered, for example, before committing to play a contract.

If the player selects one of the wagering games, the ticket will be stacked, one or more of the EGM's meters (here, the "ticket in" and credit meters) will be credited and the wagering game will be provided. (Step 360.) More details and examples regarding crediting such meters will be provided below. A message, sometimes referred to herein as a "redemption response" or the like, will be sent to the central system, e.g., to a server configured for discount ticketing functionality.

Figure 6:
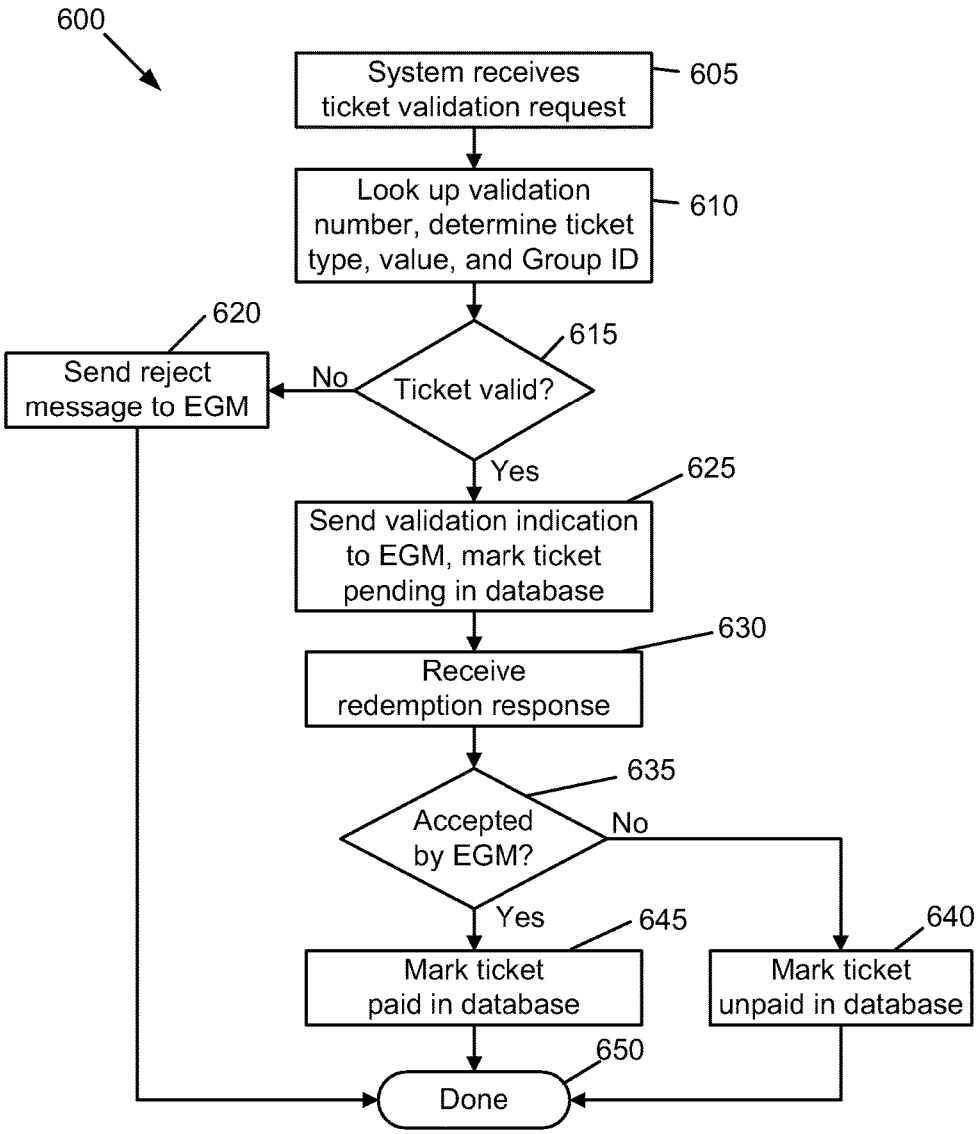
FIG. 6 is flow chart that outlines steps of some alternative methods of the invention.

FIG. 6 depicts flow chart 600, which indicates steps that may be performed by one or more devices of a discounted ticketing system according to some methods of the invention. At least some such steps may be performed by one or more servers configured for ticket validation, for analyzing and/or providing information relating to discounted tickets, etc. However, as with other methods described herein, the steps could be performed, at least in part, by more than one device.

Figure 3:
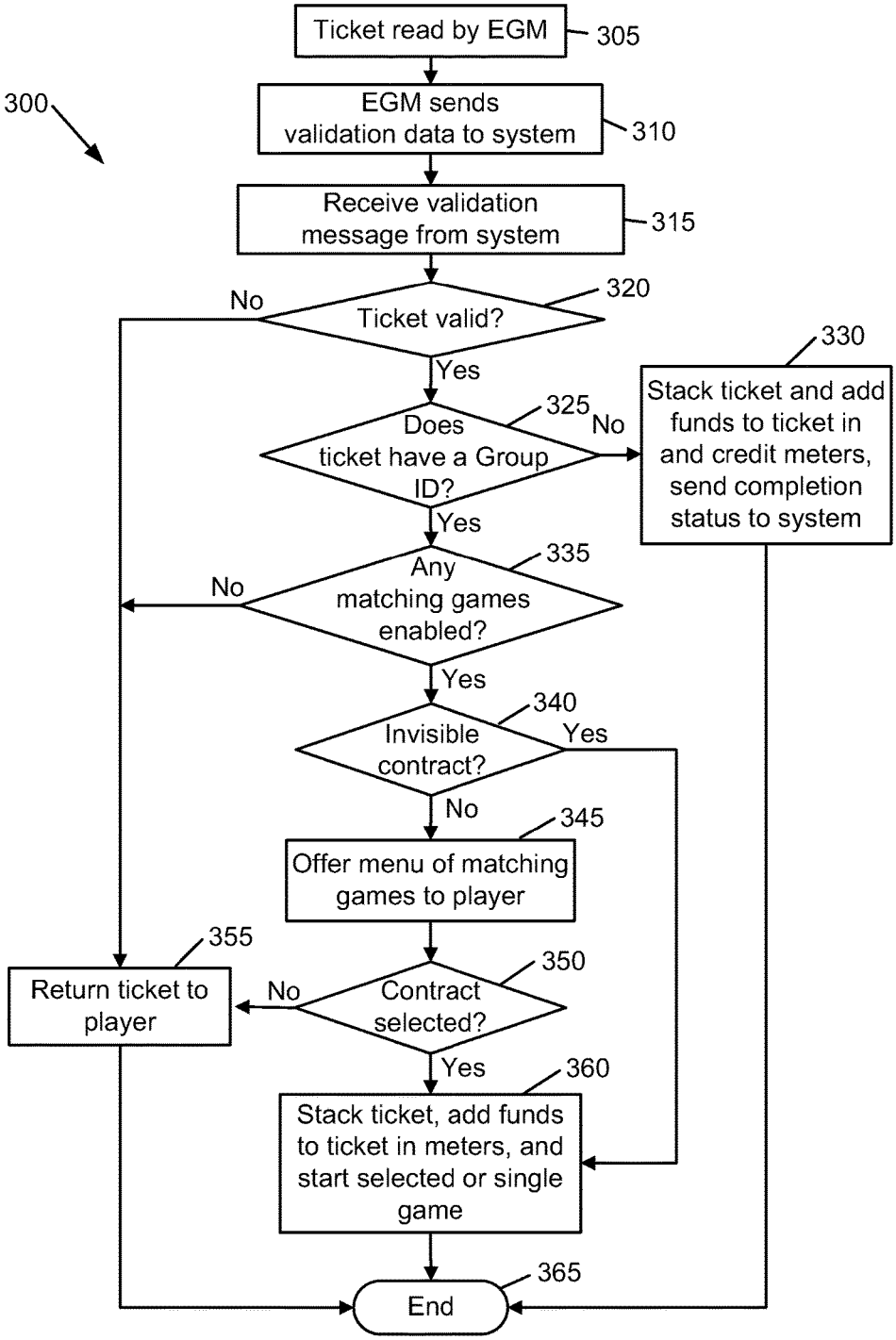
FIG. 3 is flow chart that outlines steps of some methods of the invention.

In step 605, the system receives a ticket validation request, e.g., a request that is sent according to step 310 of FIG. 3. The validation request preferably includes at least a validation number of a ticket. In this example, one or more stored data structures are then searched in an attempt to find the validation number. (Step 610.) Step 610 may also involve an attempt to determine the ticket's type (e.g., whether the ticket is a discounted ticket), to determine the ticket's value, etc., depending on the implementation.

In step 615, it is determined whether the ticket is valid. This validation step may involve determining, e.g., whether the ticket is in database, whether the ticket is not expired or otherwise date and time restricted, whether the ticket is permitted for a particular EGM's asset number, etc. As mentioned above, step 615 may also involve determining whether an individual player is entitled to use a ticket. For example, the player may be required to provide some type of player loyalty device (e.g., to insert a player loyalty card), to provide a password or other authorization data, etc. If a player loyalty device is involved, information may be received from a device of a player loyalty system (e.g., from a player loyalty server) as input to the determination of step 615.

If it is determined in step 615 that the ticket is invalid, the system will send a message to the EGM indicating that the ticket should be rejected. (Step 620.) However, if it is determined that the ticket is valid, the system will send a message to the EGM indicating that the ticket should be accepted. (Step 625.) According the some implementations, the system may send a message to the EGM indicating the ticket type, the ticket value and/or the ticket's Group ID (if applicable) to the EGM.

Therefore, ticketing information that is communicated between an EGM and a central system may include Group ID information and/or other information that was not previously required to be communicated. In some such implementations, existing protocols for the communication of ticketing information may need to be modified to include such information. For example, the SAS protocol may be modified via the addition of a group ID to, e.g., a ticket redemption message. This is preferably a variable-length string.

Whether the ticket is determined to be valid or invalid, one or more data structures are preferably updated to make a record of the transaction. If the ticket is determined to be valid, for example, a database may be updated to indicate that the ticket is currently in use.

In this example, the EGM will provide some form of ticket redemption message, whether or not the EGM actually accepts and/or stacks the ticket. (Step 630.) If the redemption message indicates that the EGM has not accepted the ticket (e.g., if no games matching a Group ID indicated by the ticket are enabled, if no enabled games are selected by the player, etc.), a data structure will be updated to indicate that the ticket is still available for use. (Step 640.) For example, the database may indicate that the ticket has been marked "unpaid." However, if the redemption message indicates that the EGM has accepted the ticket, a data structure will be updated accordingly. (Step 645.)

Accounting Issues Relating to Discounted Wager Gaming

Some implementations of the invention provide solutions to accounting challenges relating to discounted tickets. For example, a casino needs to account accurately for the cost of a discounted ticket, for a player's wins or losses when using such a ticket, etc. Casinos are required to pay taxes on their net win, not on the actual amount played. The "casino win" is what the casino has won from the player. From the player's side, it is a loss.

As noted above, the casino's "cost" may differ from the discounted ticket's value in terms of wagering game credits. In some implementations, the cost will be used as a reference in determining "coin in," wins, losses, etc. This cost may be, for example, what a patron has actually paid for a discounted ticket or may be a cost assigned by the casino. The latter case may apply, e.g., when the discounted ticket was provided as part of a package.

In some implementations, discounted cost information may not be provided a player. Accordingly, a player may be able to use a discounted ticket without being aware of the underlying cost. For example, if a casino sells a package to a patron that includes one or more discounted tickets and one or more other items (e.g., a meal, tickets to a performance, a hotel room, etc.), the casino may prefer that the patron does not know the cost that the casino assigns to the discounted ticket(s). This cost may be different from the subjective value of the discounted ticket(s) as perceived by the patron and/or the objectively value of the discounted ticket(s) as measured by the value for wager gaming.

In some implementations, two general types of discounted tickets may be provided: "purchase" tickets and "promo" tickets. A promo ticket is a ticket that is given to the player as part of a promotion. These tickets may be metered as "Coupon Promotion In" (or the like) on an EGM, and are fully marketing deductible. Promo tickets should be issued for the full retail value of the targeted contracts.

A "purchase" ticket is a ticket that the player pays for. The ticket may be purchased outright, as a book of tickets, as a part of a package deal, etc. The purchase price may or may not be equal to the "retail" contract group price.

Preferably, the purchase price, not the retail contract price, is logged in the ticket database as the ticket value. In some implementations, the purchase price is the amount the system will send to the EGM in a ticket redemption message. In other implementations, the purchase price may be encoded on a discounted ticket and read by a ticket reader associated with the EGM.

These tickets may be metered as "Voucher In" (or the like) on an EGM, and may be treated the same as a regular cashable ticket for accounting purposes. However, that does not necessarily mean that all such tickets are redeemable for cash, whether for the purchase price or otherwise. Redemption policies for purchase tickets will be up to the casino, given the laws of the applicable jurisdiction.

In some preferred implementations, the EGM will implement a variable contract price, where "Coin In" for the contract is metered at the purchase price (e.g., as the ticket value in the redemption command), not the contract's value for wager gaming purposes. The paytable, denomination and number of plays/hands remain the same. In this way, the casino "win" is always the contract's purchase price minus the player's winnings, regardless of the stated "retail" value of the contract.

For example, suppose a casino sells a GP ticket for $40. According to this contract, the player is guaranteed at least 200 slot games at $0.25 denomination. When the player uses the discounted ticket at an EGM, the purchase price is communicated to the EGM. As noted elsewhere, the purchase price may be read directly from the ticket, the purchase price may be indicated in a communication from a device of a ticketing system (e.g., a server), etc.

The EGM will record $40 as the total wagered amount for the contract, rather than the $50 value of the ticket when used in wager gaming (200 plays*$0.25/play). The player does not need to see a $40 or a $50 "coin in." The player may simply see, e.g., a credit for 200 games.

In this example, the contract entitles the player to 200 plays and cost $40, or $0.20 per hand. Therefore, the EGM adds $0.20 to the "coin in" meter each time the player plays a game. If the player wins, the win amount is available for cashing out.

In another example, suppose that a player is using a discounted ticket for a poker game that has a $0.25 denomination and the player is playing 5 credits per hand. In this example, the contract entitles the player to 100 hands and cost the player $10, or $0.10 per hand. Moreover, suppose the player wins $1.25. That $1.25 would be available for cashing out. However, if the player plays a win amount, it would be added to the "coin in" meter. For example, if the player wagered that $1.25 win and lost it on the next hand, the player would lose $1.25 plus $0.10 for the hand, a total of $1.35. The EGM would decrement the positive amount from the player's session balance (here, the $1.25), plus the amortized value of the session (here, $0.10 for each hand).

Suppose the player had only paid $8 for the 100-game session. The EGM would indicate $0.08 "coin in" for each game (in other words, the "coin in" would increment by $0.08 for each game). If the player won $10 after playing all 100 games, the casino would lose $2 (a "net win" for the casino of −$2). (100 games*($0.08/game)=$8) "coin in"−($10 player win)=−$2.

These accounting methods do not apply only to GP tickets, but instead are broadly applicable to all types of discounted tickets. For example, a player may pay $80 for a ticket having $100 of value when used for wager gaming, e.g., at a particular casino. If the player were to, e.g., insert the discounted ticket into an EGM, the EGM may indicate shows $100 of credits (preferably of non-cashable credits). Preferably, the EGM recognizes that this represents an $80 purchase and meters the "coin in" accordingly, as described above.

The ticket may have a code that could be referenced in a database of the EGM (or a server, host device, etc.). The database may indicate, e.g., "this ticket is worth $100 of play." It may also indicate that the ticket cost $80. The database (or a logic device interpreting data from the database) may also indicate to the EGM how much to meter the ticket for and how much to display the ticket for.

The EGM could, e.g., display $100 worth of credits to the player. However, for a dollar-denominated game, the EGM would preferably meter the "coin in" as $0.80/game. In other words, the meter seen by the player might decrement by $1/game, but the "coin in" meter might increment at a different rate (here, by $0.80/game). Accordingly, some implementations of the invention involve metering "coin in" at a different rate than the decremented credit present to a player.

Some networks described herein provide methods and devices for managing one or more networked gaming establishments. Such networks may sometimes be referred to herein as server-based gaming networks, Sb™ networks, or the like. Some such gaming networks described herein allow for the convenient provisioning of networked gaming machines and other devices relevant to casino operations. Game themes may be easily and conveniently added or changed, if desired. Related software, including but not limited to player tracking software, peripheral software, etc., may be downloaded to networked gaming machines and other devices, such as kiosks, networked gaming tables, player stations, etc.

Relevant information is set forth in U.S. patent application Ser. No. 11/225,407, by Wolf et al., entitled "METHODS AND DEVICES FOR MANAGING GAMING NETWORKS" and filed Sep. 12, 2005, in U.S. patent application Ser. No. 10/757,609 by Nelson et al., entitled "METHODS AND APPARATUS FOR GAMING DATA DOWNLOADING" and filed on Jan. 14, 2004, in U.S. patent application Ser. No. 10/938,293 by Benbrahim et al., entitled "METHODS AND APPARATUS FOR DATA COMMUNICATION IN A GAMING SYSTEM" and filed on Sep. 10, 2004, in U.S. patent application Ser. No. 11/225,337 by Nguyen et al., filed Sep. 12, 2005 and entitled "DISTRIBUTED GAME SERVICES," in U.S. patent application Ser. No. 11/225,408 by Kinsley et al., entitled "METHODS AND DEVICES FOR AUTHENTICATION AND LICENSING IN A GAMING NETWORK" and filed Aug. 1, 2005, in U.S. patent application Ser. No. 11/078,966 by Nguyen et al., filed Mar. 10, 2005 and entitled "SECURED VIRTUAL NETWORK IN A GAMING ENVIRONMENT," in U.S. patent application Ser. No. 11/173,442 by Kinsley et al., filed Jul. 1, 2005 and entitled "METHODS AND DEVICES FOR DOWNLOADING GAMES OF CHANCE" and in U.S. patent application Ser. No. 11/810,888 by Graham et al., filed Jun. 6, 2007 and entitled "DATABASE QUERIES WITHIN A GAMING MACHINE," all of which are hereby incorporated by reference in their entirety and for all purposes.

Some such networks include devices that provide functionality relating to the present invention. For example, networked devices, including but not limited to gaming machines, kiosks, gaming tables, etc., may have associated readers for discounted tickets (or the like). Local and/or central servers (and/or other devices) may be configured for functionality related to discounted wager gaming, such as ticket validation functionality, accounting functionality and/or other functionality described herein.

Figure 7:
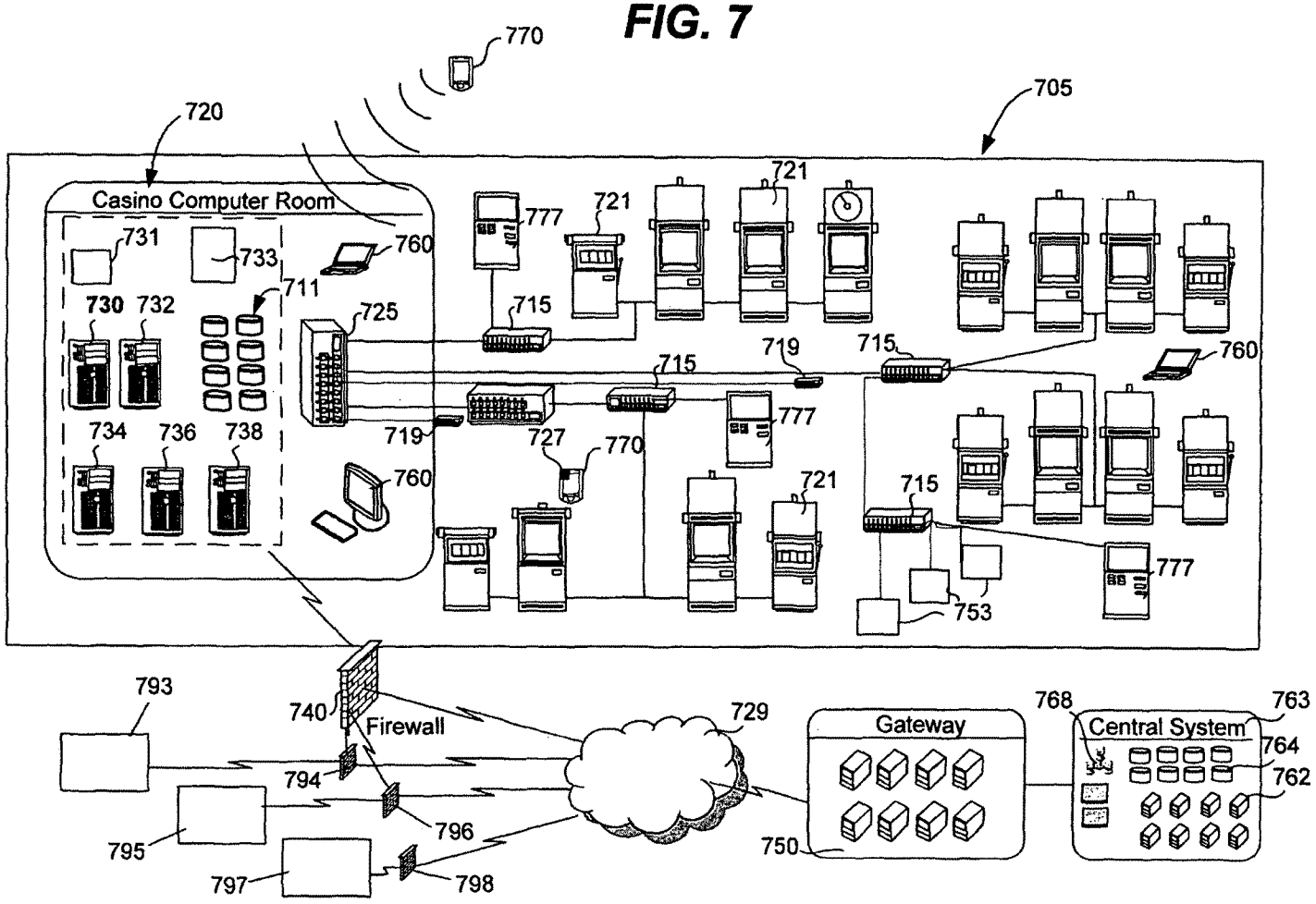
FIG. 7 illustrates a gaming network that may be used for some implementations of the invention.

One example of an Sb™ network is depicted in FIG. 7. Those of skill in the art will realize that this architecture and the related functionality are merely examples and that the present invention encompasses many other such embodiments and methods. Moreover, other devices that may be used in connection with the present invention do not appear in FIG. 7. For example, a network for implementing the present invention would preferably include a plurality of networked cameras, such as video cameras, smart cameras, digital still cameras, etc., such as those described above with reference to FIGS. 1A through 1D. Moreover, a network for implementing the present invention may also include various RFID readers, RFID switches, middleware servers, etc.

Here, casino computer room 720 and networked devices of a gaming establishment 705 are illustrated. Gaming establishment 705 is configured for communication with central system 763 via gateway 750. Gaming establishments 793 and 795 are also configured for communication with central system 763.

In some implementations, gaming establishments may be configured for communication with one another. In this example, gaming establishments 793 and 795 are configured for communication with casino computer room 720. Such a configuration may allow devices and/or operators in casino 705 to communicate with and/or control devices in other casinos. In some such implementations, a server in computer room 720 may control devices in casino 705 and devices in other gaming establishments. Conversely, devices and/or operators in another gaming establishment may communicate with and/or control devices in casino 705.

For example, a server of casino 705 or central system 763 may be provisioned with relatively more advanced software (e.g., 3-D facial recognition software) for patron identification than servers of other networked locations. Such a server may process patron identification requests from devices in casino 705 as well as patron identification requests from devices in gaming establishments 793 and 795.

Here, gaming establishment 797 is configured for communication with central system 763, but is not configured for communication with other gaming establishments. Some gaming establishments (not shown) may not be in communication with other gaming establishments or with a central system.

Gaming establishment 705 includes multiple gaming machines 721, each of which is part of a bank 710 of gaming machines 721. In this example, gaming establishment 705 also includes a bank of networked gaming tables 753. However, the present invention may be implemented in gaming establishments having any number of gaming machines, gaming tables, etc. It will be appreciated that many gaming establishments include hundreds or even thousands of gaming machines 721 and/or gaming tables 753, not all of which are necessarily included in a bank and some of which may not be connected to a network.

Some gaming networks provide features for gaming tables that are similar to those provided for gaming machines, including but not limited to bonusing, player loyalty/player tracking and the use of cashless instruments. Relevant material is provided in U.S. patent application Ser. No. 11/154,833, entitled "CASHLESS INSTRUMENT BASED TABLE GAME PROMOTIONAL SYSTEM AND METHODOLOGY" and filed on Jun. 15, 2005, U.S. Provisional Patent Application No. 60/858,046, entitled "AUTOMATED PLAYER DATA COLLECTION SYSTEM FOR TABLE GAME ENVIRONMENTS" and filed on Nov. 10, 2006, U.S. patent application Ser. No. 11/129,702, entitled "WIDE AREA TABLE GAMING MONITOR AND CONTROL SYSTEM" and filed on May 15, 2005, U.S. patent application Ser. No. 11/425,998 entitled "PROGRESSIVE TABLE GAME BONUSING SYSTEMS AND METHODS", filed Jun. 22, 2006 and U.S. patent application Ser. No. 11/225,299, entitled "UNIVERSAL CASINO BONUSING SYSTEMS AND METHODS" and filed on Sep. 12, 2005, all of which are incorporated herein by reference. Accordingly, software related to such features may be provided and/or controlled, and related data may be obtained and/or provided, according to the present invention.

Some configurations can provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras, radio frequency identification devices, etc., may be used to identify and/or track playing cards, chips, etc. Some of gaming tables 753 may be configured for communication with individual player terminals (not shown), which may be configured to accept bets, present an electronic representation of a dealer, indicate game outcomes, etc.

Some gaming networks include electronically configurable tables for playing table games. U.S. patent application Ser. No. 11/517,861, entitled "CASINO DISPLAY METHODS AND DEVICES" and filed on Sep. 7, 2006, describes some such tables and is hereby incorporated by reference. An operator may select a desired game, such as a poker game or a blackjack game, and the table will be automatically configured with geometrical patterns, text, etc., which are appropriate for the desired table game. The desired type of table game may be selected by a control on the table itself or according to instructions received from, e.g., a server or a casino manager via a network interface.

Gaming establishment 705 also includes networked kiosks 777. Depending on the implementation, kiosks 777 may be used for various purposes, including but not limited to cashing out, prize redemption, redeeming points from a player loyalty program, redeeming "cashless" indicia such as bonus tickets, smart cards, etc. In some implementations, kiosks 777 may be used for obtaining information about the gaming establishment, e.g., regarding scheduled events (such as tournaments, entertainment, etc.), regarding a patron's location, etc. Software related to such features may be provided and/or controlled, and related data may be obtained and/or provided, according to the present invention.

In this example, each bank 710 has a corresponding switch 715, which may be a conventional bank switch in some implementations. Each switch 715 is configured for communication with one or more devices in computer room 720 via main network device 725, which combines switching and routing functionality in this example. Although various communication protocols may be used, some preferred implementations use the Gaming Standards Association's G2S Message Protocol. Other implementations may use IGT's open, Ethernet-based SuperSAS® protocol, which IGT makes available for downloading without charge. Still other protocols, including but not limited to Best of Breed ("BOB"), may be used to implement various aspects of the invention. IGT has also developed a gaming-industry-specific transport layer called CASH that rides on top of TCP/IP and offers additional functionality and security.

Here, gaming establishment 705 also includes an RFID network, implemented in part by RFID switches 719 and multiple RFID readers (not shown). An RFID network may be used, for example, to track objects (such as mobile gaming devices), patrons, etc., in the vicinity of gaming establishment 705. Some examples of how an RFID network may be used in a gaming establishment are set forth in U.S. patent application Ser. No. 11/655,496, entitled "DYNAMIC CASINO TRACKING AND OPTIMIZATION" and filed on Jan. 19, 2007 and in U.S. patent application Ser. No. 11/599,241, entitled "DOWNLOADING UPON THE OCCURRENCE OF PREDETERMINED EVENTS" and filed on Nov. 13, 2006, both of which are hereby incorporated by reference.

As noted elsewhere herein, some implementations of the invention may involve "smart" player loyalty instruments, such as player tracking cards, that include an RFID tag. Accordingly, the location of such RFID-enabled player loyalty instruments may be tracked via the RFID network. In this example, at least some of mobile devices 770 may include an RFID tag 727, which includes encoded identification information for the mobile device 770. Accordingly, the locations of such tagged mobile devices 770 may be tracked via the RFID network in gaming establishment 705. Other location-detection devices and systems, such as the global positioning system ("GPS"), may be used to monitor the location of people and/or devices in the vicinity of gaming establishment 705 or elsewhere.

Various alternative network topologies can be used to implement different aspects of the invention and/or to accommodate varying numbers of networked devices. For example, gaming establishments with large numbers of gaming machines 721 may require multiple instances of some network devices (e.g., of main network device 725, which combines switching and routing functionality in this example) and/or the inclusion of other network devices not shown in FIG. 7. Some implementations of the invention may include one or more middleware servers disposed between kiosks 777, RFID switches 719 and/or bank switches 715 and one or more devices in computer room 720 (e.g., a corresponding server). Such middleware servers can provide various useful functions, including but not limited to the filtering and/or aggregation of data received from switches, from individual gaming machines and from other devices. Some implementations of the invention include load-balancing methods and devices for managing network traffic.

Storage devices 711, Sb™ server 730, License Manager 731, Arbiter 733, servers 732, 734, 736 and 738, host device(s) 760 and main network device 725 are disposed within computer room 720 of gaming establishment 705. In practice, more or fewer devices may be used. Depending on the implementation, some such devices may reside in gaming establishment 705 or elsewhere.

One or more devices in central system 763 may also be configured to perform, at least in part, tasks specific to the present invention. For example, one or more servers 762, storage devices 764 and/or host devices 760 of central system 763 may be configured to implement the functions described in detail elsewhere herein. For example, one or more of the servers of computer room 720 may be configured to provide accounting functions, ticket validation functions and other functions, e.g., relating to the steps described with reference to FIG. 6.

These servers may be configured for communication with other devices in or outside of gaming establishment 705, such as host devices 760 and mobile devices 770, for implementing some methods described elsewhere herein. Host devices 760 and mobile devices 770, some of which may be associated with computer room 720, may be used to provide the graphical user interfaces and related functionality described above, e.g., with reference to FIGS. 3A through 3G.

Some of these servers may be configured to perform tasks relating to accounting, player loyalty, bonusing/progressives, configuration of gaming machines, etc. One or more such devices may be used to implement a casino management system, such as the IGT Advantage™ Casino System suite of applications, which provides instantaneous information that may be used for decision-making by casino managers. A Radius server and/or a DHCP server may also be configured for communication with the gaming network. Some implementations of the invention provide one or more of these servers in the form of blade servers.

Some preferred embodiments of Sb™ server 730 and the other servers shown in FIG. 7 include (or are at least in communication with) clustered CPUs, redundant storage devices, including backup storage devices, switches, etc. Such storage devices may include a "RAID" (originally redundant array of inexpensive disks, now also known as redundant array of independent disks) array, back-up hard drives and/or tape drives, etc.

In some implementations of the invention, many of these devices (including but not limited to License Manager 731, servers 732, 734, 736 and 738, and main network device 725) are mounted in a single rack with Sb™ server 730. Accordingly, many or all such devices will sometimes be referenced in the aggregate as an "Sb™ server." However, in alternative implementations, one or more of these devices is in communication with Sb™ server 730 and/or other devices of the network but located elsewhere. For example, some of the devices could be mounted in separate racks within computer room 720 or located elsewhere on the network. Moreover, it can be advantageous to store large volumes of data elsewhere via a storage area network ("SAN").

Computer room 720 may include one or more operator consoles or other host devices that are configured for communication with other devices within and outside of computer room 720. Such host devices may be provided with software, hardware and/or firmware for implementing various aspects of the invention. However, such host devices need not be located within computer room 720. Wired host devices 760 (which are desktop and laptop computers in this example) and wireless devices 770 (which are PDAs in this example) may be located elsewhere in gaming establishment 705 or at a remote location.

Some embodiments of the invention include devices for implementing access control, security and/or other functions relating to the communication between different devices on the network. In this example, arbiter 733 serves as an intermediary between different devices on the network. Arbiter 733 may be implemented, for example, via software that is running on a server or another networked device. Some implementations of Arbiter 733 are described in U.S. patent application Ser. No. 10/948,387, entitled "METHODS AND APPARATUS FOR NEGOTIATING COMMUNICATIONS WITHIN A GAMING NETWORK" and filed Sep. 23, 2004 (the "Arbiter Application"), which is incorporated herein by reference and for all purposes. In some preferred implementations, Arbiter 733 is a repository for the configuration information required for communication between devices on the gaming network (and, in some implementations, devices outside the gaming network). Although Arbiter 733 can be implemented in various ways, one exemplary implementation is discussed in the following paragraphs.

Figure 8:
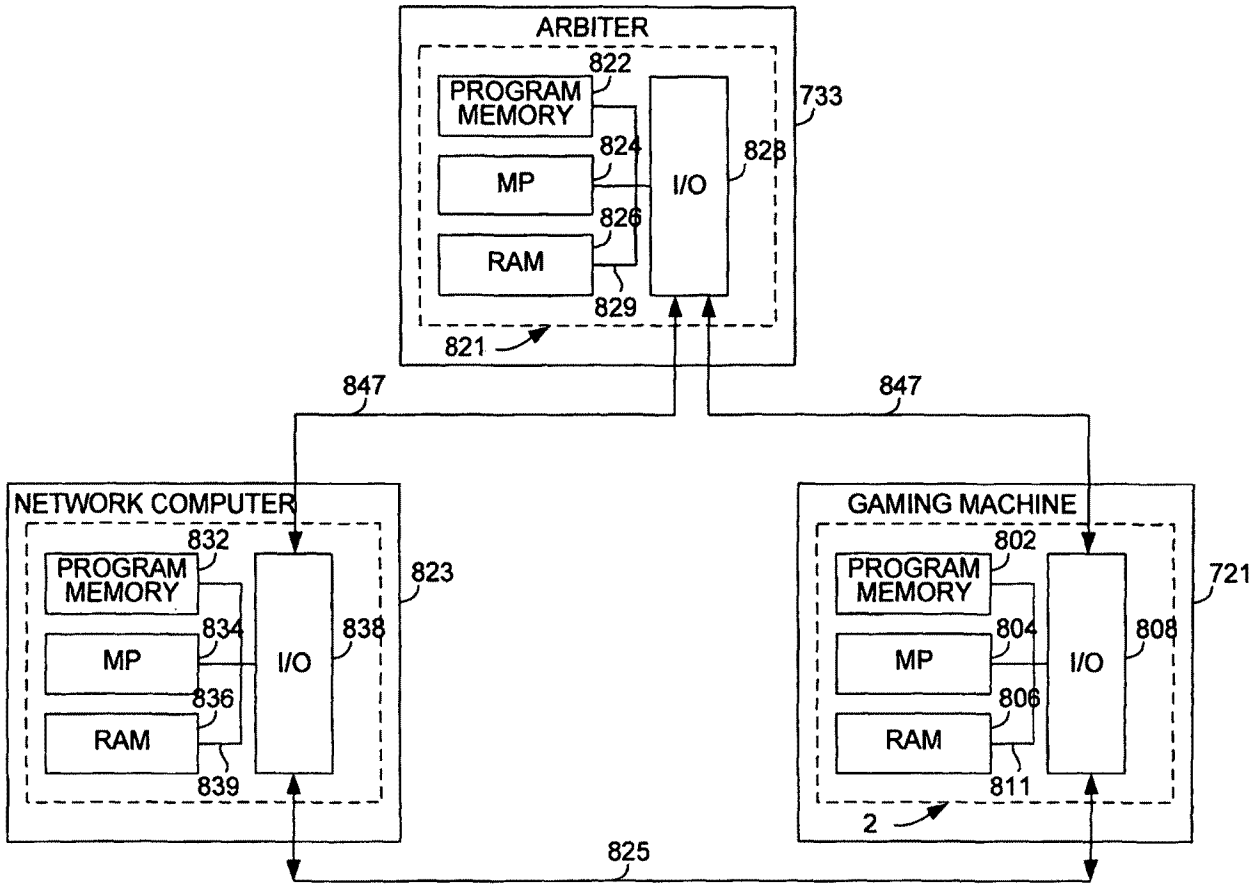
FIG. 8 is a block diagram of an Arbiter and other devices that may be used for some implementations of the invention.

FIG. 8 is a block diagram of a simplified communication topology between gaming machine 721, network computer 823 and Arbiter 733. Network computer 823 may be, for example, a server or other device within computer room 720 or elsewhere. Although only one gaming machine 721, one network computer 823 and one Arbiter 733 are shown in FIG. 8, it should be understood that the following examples may be applicable to different types of networked devices in addition to gaming machine 721 and network computer 823, and may include different numbers of network computers 823, Arbiters 733 and gaming machines 721. For example, a single Arbiter 733 may be used for secure communications among a plurality of network computers 823 and tens, hundreds or thousands of gaming machines 721. Likewise, multiple Arbiters 733 may be utilized for improved performance and other scalability factors.

Referring to FIG. 8, the Arbiter 733 may include an arbiter controller 821 that may comprise a program memory 822, a microcontroller or microprocessor (MP) 824, a random-access memory (RAM) 826 and an input/output (I/O) circuit 828, all of which may be interconnected via an address/data bus 829. The network computer 823 may also include a controller 831 that may comprise a program memory 832, a microcontroller or microprocessor (MP) 834, a random-access memory (RAM) 836 and an input/output (I/O) circuit 838, all of which may be interconnected via an address/data bus 839. It should be appreciated that although the Arbiter 733 and the network computer 823 are each shown with only one microprocessor 824, 834, the controllers 821, 831 may each include multiple microprocessors 824, 834. Similarly, the memory of the controllers 821, 831 may include multiple RAMs 826, 836 and multiple program memories 822, 832. Although the I/O circuits 828, 838 are each shown as a single block, it should be appreciated that the I/O circuits 828, 838 may include a number of different types of I/O circuits. The RAMs 824, 834 and program memories 822, 832 may be implemented as semiconductor memories, magnetically readable memories, and/or optically readable memories, for example.

Although the program memories 822, 832 are shown in FIG. 8 as read-only memories (ROM) 822, 832, the program memories of the controllers 821, 831 may be a read/write or alterable memory, such as a hard disk. In the event a hard disk is used as a program memory, the address/data buses 829, 839 shown schematically in FIG. 8 may each comprise multiple address/data buses, which may be of different types, and there may be an I/O circuit disposed between the address/data buses.

As shown in FIG. 8, the gaming machine 721 may be operatively coupled to the network computer 823 via the data link 825. The gaming machine 721 may also be operatively coupled to the Arbiter 733 via the data link 849, and the network computer 823 may likewise be operatively coupled to the Arbiter 733 via the data link 847.

Communications between the gaming machine 721 and the network computer 823 may involve different information types of varying levels of sensitivity resulting in varying levels of encryption techniques depending on the sensitivity of the information. For example, communications such as drink orders and statistical information may be considered less sensitive. A drink order or statistical information may remain encrypted, although with moderately secure encryption techniques, such as RC4, resulting in less processing power and less time for encryption. On the other hand, financial information (e.g., account information, winnings, etc.), download information (e.g., game and/or peripheral software, licensing information, etc.) and personal information (e.g., social security number, personal preferences, etc.) may be encrypted with stronger encryption techniques such as DES, 3DES or AES to provide increased security.

As disclosed in further detail in the Arbiter Application, the Arbiter 733 may verify the authenticity of devices in the gaming network, including but not limited to devices sending queries and/or remote procedure calls to gaming machines. The Arbiter 733 may receive a request for a communication session from a network device. For ease of explanation, the requesting network device may be referred to as the client, and the requested network device may be referred to as the host. The client may be any device on the network and the request may be for a communication session with any other network device. The client may specify the host, or the gaming security arbiter may select the host based on the request and based on information about the client and potential hosts. The Arbiter 733 may provide encryption keys (session keys) for the communication session to the client via the secure communication channel. Either the host and/or the session key may be provided in response to the request, or may have been previously provided. The client may contact the host to initiate the communication session. The host may then contact the Arbiter 733 to determine the authenticity of the client. The Arbiter 733 may provide affirmation (or lack thereof) of the authenticity of the client to the host and provide a corresponding session key, in response to which the network devices may initiate the communication session directly with each other using the session keys to encrypt and decrypt messages.

Alternatively, upon receiving a request for a communication session, the Arbiter 733 may contact the host regarding the request and provide corresponding session keys to both the client and the host. The Arbiter 733 may then initiate either the client or the host to begin their communication session. In turn, the client and host may begin the communication session directly with each other using the session keys to encrypt and decrypt messages. An additional explanation of the communication request, communication response and key distribution is provided in the Arbiter Application.

Referring again to FIG. 7, the communication link(s) between casino 705 and central system 763 preferably have ample bandwidth and may, for example, comprise one or more T1 or T3 connections and/or satellite links having comparable bandwidth, etc. Network 729 is the Internet in this example. However, it will be understood by those of skill in the art that network 729 could include any one of various types of networks, such as the public switched telephone network ("PSTN"), a satellite network, a wireless network, a metro optical transport, etc. Accordingly, a variety of protocols may be used for communication on network 729, such as Internet Protocol ("IP"), Fibre Channel ("FC"), FC over IP ("FCIP"), Internet SCSI ("iSCSI," an IP-based standard for linking data storage devices over a network and transferring data by carrying SCSI commands over IP networks) or Dense Wavelength Division Multiplexing ("DWDM," an optical technology used to increase bandwidth over existing fiber optic backbones).

If a host device is located in a remote location, security methods and devices (such as firewalls, authentication and/or encryption) should be deployed in order to prevent the unauthorized access of the gaming network.

Similarly, any other connection between gaming network 705 and the outside world should only be made with trusted devices via a secure link, e.g., via a virtual private network ("VPN") tunnel. For example, the illustrated connection between Sb™ server 730, gateway 750 and central system 763 (that may be used for communications involving peripheral device software downloads, etc.) is advantageously made via a VPN tunnel. Details of VPN methods that may be used with the present invention are described in the reference, "Virtual Private Networks-Technologies and Solutions," by R. Yueh and T. Strayer, Addison-Wesley, 2001, ISBN#0-201-70209-6, which is incorporated herein by reference and for all purposes. Additionally VPNs may be implemented using a variety of protocols, such as, for example, IP Security (IPSec) Protocol, Layer 2 Tunneling Protocol, Multiprotocol Label Switching (MPLS) Protocol, etc. Details of these protocols, including RFC reports, may be obtained from the VPN Consortium, an industry trade group (http://www.vpnc.com, VPNC, Santa Cruz, Calif.).

Alternatively, a permanent virtual circuit ("PVC") can be established to provide a dedicated and secure circuit link between two facilities, e.g., between a casino and central system 763. A PVC is a virtual circuit established for repeated use between the same data terminals. A PVC could be provided, for example, via AT&T's Asynchronous Transfer Mode ("ATM") switching fabric. Some implementations provide a dedicated line from an endpoint (e.g., from casino 705) into the ATM backbone. Other implementations provide a connection over another network (e.g., the Internet) between an endpoint and the nearest device of the ATM backbone, e.g., to the nearest edge router. In some such implementations, the fixed-sized cells used in the ATM switching fabric may be encapsulated in variable sized packets (such as Internet Protocol or Ethernet packets) for transmission to and from the ATM backbone.

For security purposes, information transmitted to, on or from a gaming establishment may be encrypted. In one implementation, the information may be symmetrically encrypted using a symmetric encryption key, where the symmetric encryption key is asymmetrically encrypted using a private key. The public key may, for example, be obtained from a remote public key server. The encryption algorithm may reside in processor logic stored on the gaming machine. When a remote server receives a message containing the encrypted data, the symmetric encryption key is decrypted with a private key residing on the remote server and the symmetrically encrypted information sent from the gaming machine is decrypted using the symmetric encryption key. A different symmetric encryption key is used for each transaction where the key is randomly generated. Symmetric encryption and decryption is preferably applied to most information because symmetric encryption algorithms tend to be 100-10,000 faster than asymmetric encryption algorithms.

Some network implementations may use Trusted Network Connect ("TNC"), which is an open architecture provided by the Trusted Network Connect Sub Group ("TNC-SG") of the Trusted Computing Group (TCG). TNC enables network operators to provide endpoint integrity at every network connection, thus enabling interoperability among multi-vendor network endpoints. Alternatively, or additionally, the Secure Internet File Transfer ("SIFT") may be employed. SIFT allows devices to send and receive data over the Internet in a secure (128-bit encryption) method of transport.

Providing secure connections between devices in a gaming network, such as the connections between the local devices of the gaming network 705 and central system 763, allows for the deployment of many advantageous features. For example, a customer (e.g., an employee of a gaming establishment) may be able to log onto an account of central system 763 to obtain the account information such as the customer's current and prior account status. Automatic updates of a customer's software may also be enabled. For example, central system 763 may notify one or more devices in gaming establishment 705 regarding new products and/or product updates. For example, central system 763 may notify server (or other device) in computer room 720 regarding new software, software updates, the status of current software licenses, etc. Alternatively, such updates could be automatically provided to a server in computer room 720 and downloaded to networked gaming machines.

After the local server receives this information, relevant products of interest may be identified (by the server, by another device or by a human being). If an update or a new software product is desired, it can be downloaded from the central system. Similarly, a customer may choose to renew a software license via a secure connection with central system 763, e.g., in response to a notification that the software license is required.

In addition, providing secure connections between different gaming establishments can enable alternative implementations of the invention. For example, a number of gaming establishments may be owned and/or controlled by the same entity. In such situations, having secure communications between gaming establishments makes it possible for a gaming entity to use one or more servers in a gaming establishment as an interface between central system 763 and gaming machines in multiple gaming establishments. For example, new or updated software may be obtained by a server in one gaming establishment and distributed to gaming machines in that gaming establishment and/or other gaming establishments. A server in one gaming establishment may perform services, such as patron identification services, in response to a request from a device in another gaming establishment.

Figure 9:
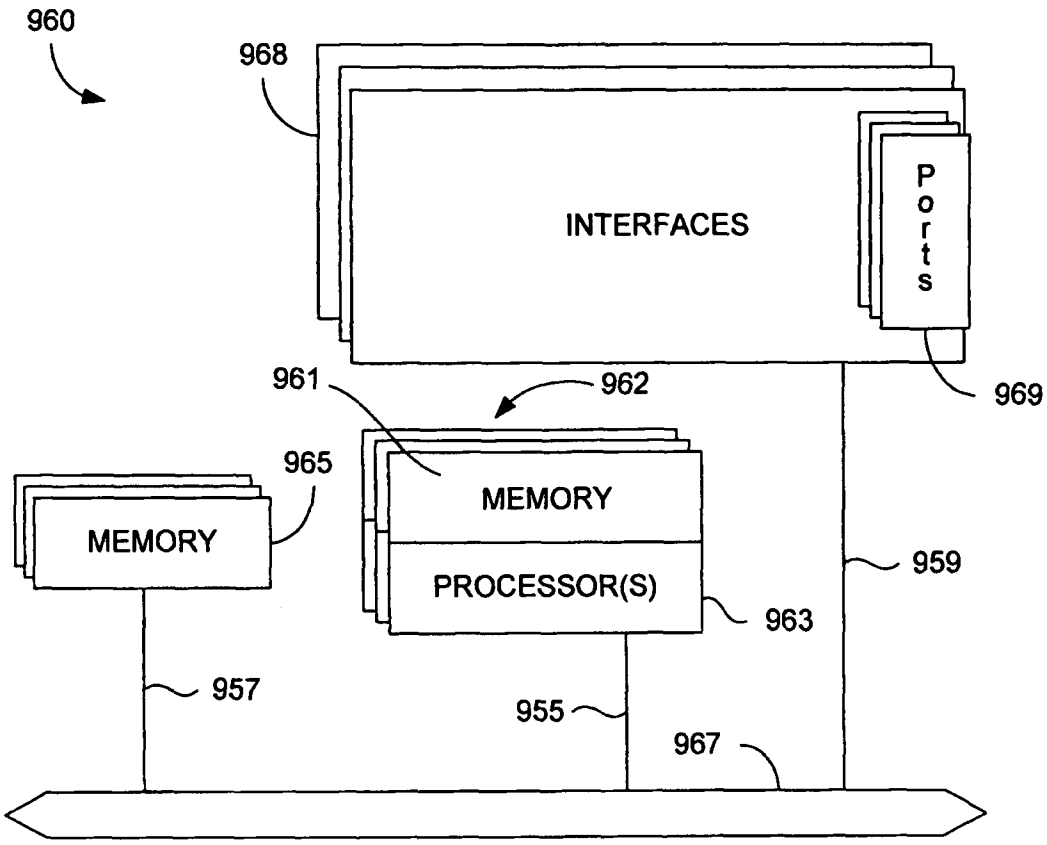
FIG. 9 is a diagram of a server that may be configured according to some implementations of the invention.

FIG. 9 illustrates an example of a network device that may be configured for implementing some methods of the present invention. Network device 960 includes a master central processing unit (CPU) 962, interfaces 968, and a bus 967 (e.g., a PCI bus). Generally, interfaces 968 include ports 969 appropriate for communication with the appropriate media. In some embodiments, one or more of interfaces 968 includes at least one independent processor and, in some instances, volatile RAM. The independent processors may be, for example, ASICs or any other appropriate processors. According to some such embodiments, these independent processors perform at least some of the functions of the logic described herein. In some embodiments, one or more of interfaces 968 control such communications-intensive tasks as encryption, decryption, compression, decompression, packetization, media control and management. By providing separate processors for the communications-intensive tasks, interfaces 968 allow the master microprocessor 962 efficiently to perform other functions such as routing computations, network diagnostics, security functions, etc.

The interfaces 968 are typically provided as interface cards (sometimes referred to as "linecards"). Generally, interfaces 968 control the sending and receiving of data packets over the network and sometimes support other peripherals used with the network device 960. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 962 may be responsible for implementing specific functions associated with the functions of a desired network device. According to some embodiments, CPU 962 accomplishes all these functions under the control of software including an operating system and any appropriate applications software.

CPU 962 may include one or more processors 963 such as a processor from the Motorola family of microprocessors or the MIPS family of microprocessors. In an alternative embodiment, processor 963 is specially designed hardware for controlling the operations of network device 960. In a specific embodiment, a memory 961 (such as non-volatile RAM and/or ROM) also forms part of CPU 962. However, there are many different ways in which memory could be coupled to the system. Memory block 961 may be used for a variety of purposes such as, for example, caching and/or storing data, programming instructions, etc.

Regardless of network device's configuration, it may employ one or more memories or memory modules (such as, for example, memory block 965) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 9 illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 9) or switch fabric based (such as a cross-bar).

Figure 10:
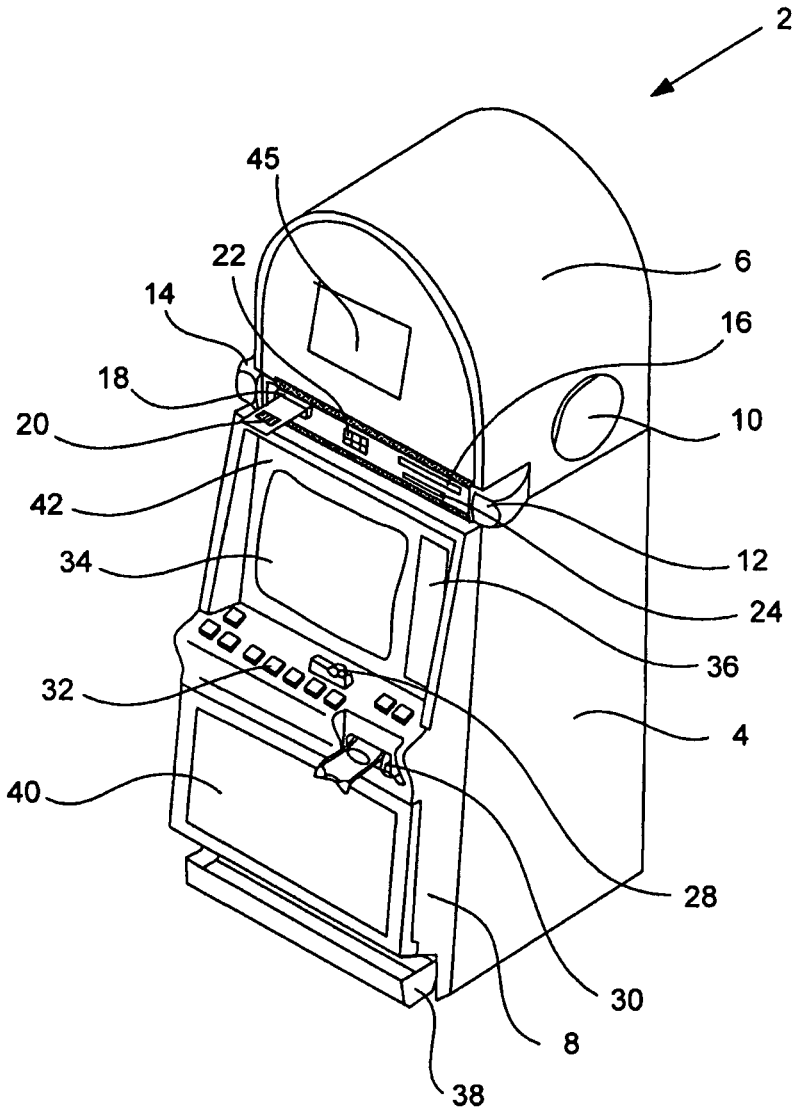
FIG. 10 depicts a wager gaming machine that may be configured according to some implementations of the invention.

Turning next to FIG. 10, a video gaming machine 2 of the present invention is shown. Machine 2 includes a main cabinet 4, which generally surrounds the machine interior (not shown) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 will typically be a cathode ray tube, high resolution flat-panel LCD, or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. The devices are controlled by circuitry (e.g. the master gaming controller) housed inside the main cabinet 4 of the machine 2.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may executed game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

The gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display screen 42. The ticket printer 18 may be used to print tickets for a cashless ticketing system. Further, the top box 6 may house different or additional devices than shown in FIG. 10. For example, the top box may contain a bonus wheel or a back-lit silk screened panel which may be used to add bonus features to the game being played on the gaming machine. As another example, the top box may contain a display for a progressive jackpot offered on the gaming machine. During a game, these devices are controlled and powered, in part, by circuitry (e.g. a master gaming controller) housed within the main cabinet 4 of the machine 2.

Understand that gaming machine 2 is but one example from a wide range of gaming machine designs on which the present invention may be implemented. For example, not all suitable gaming machines have top boxes or player tracking features. Further, some gaming machines have only a single game display—mechanical or video, while others are designed for bar tables and have displays that face upwards. As another example, a game may be generated in on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that the present invention, as described below, can be deployed on most any gaming machine now available or hereafter developed.

Some preferred gaming machines of the present assignee are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

A watchdog timer is normally used in IGT gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits contain a loadable timeout counter register to allow the operating software to set the timeout interval within a certain range of time. A differentiating feature of the some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion.

Another feature of gaming machines, such as IGT gaming computers, is that they often contain unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, IGT's Netplex is a proprietary communication protocol used for serial communication between gaming devices. As another example, SAS is a communication protocol used to transmit information, such as metering information, from a gaming machine to a remote device. Often SAS is used in conjunction with a player tracking system.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms contained in the trusted device, the gaming machine is allowed to verify the authenticity of additional code and data that may be located in the gaming computer assembly, such as code and data stored on hard disk drives. A few details related to trusted memory devices that may be used in the present invention are described in U.S. Pat. No. 6,685,567 from U.S. patent application Ser. No. 09/925,098, filed Aug. 8, 2001 and titled "Process Verification," which is incorporated herein in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present.

Returning to the example of FIG. 10, when a user wishes to play the gaming machine 2, he or she inserts cash through the coin acceptor 28 or bill validator 30. Additionally, the bill validator may accept a printed ticket voucher which may be accepted by the bill validator 30 as an indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display screen 42 located in the top box.

During the course of a game, a player may be required to make a number of decisions, which affect the outcome of the game. For example, a player may vary his or her wager on a particular game, select a prize for a particular game selected from a prize server, or make game decisions that affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing.

Auditory effects include various sounds that are projected by the speakers 10, 12, 14. Visual effects include flashing lights, strobing lights or other patterns displayed from lights on the gaming machine 2 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

While this invention is described in terms of preferred embodiments, there are alterations, permutations, and equivalents that fall within the scope of the invention. It should also be noted that there are many alternative ways of implementing the present invention. It is therefore intended that the invention not be limited to the preferred embodiments described herein, but instead that the invention should be interpreted as including all such alterations, permutations, and equivalents as fall within the true spirit and scope of the present invention.

We claim:

1. An electronic wagering gaming machine, comprising:
a housing including a door;
a security switch attached to the door of the housing and configured to detect an opening of the door;
a display device supported by the housing;
a ticket reader supported by the housing;
a wager button supported by the housing;
a cashout button supported by the housing;
at least one input device supported by the housing;
a processor; and
a memory device that stores a plurality of instructions that, when executed by the processor, cause the processor to:
receive, via the ticket reader, a ticket including a code;
read, via the ticket reader, the code of the ticket and determine a group identification code based on the read code;
determine whether the group identification code corresponds to an invisible game, wherein the invisible game is not presented in any menus on the display device for game play selection and wherein the invisible game is accessible via a discounted ticket that is obtained at a price below a value of the discounted ticket when used for wager gaming and that is obtained as part of a package that includes at least one non-wager gaming related item;
responsive to the group identification code corresponding to the invisible game, display, via the display device, a play of the invisible game including a randomly determined invisible game outcome;
responsive to the group identification code not corresponding to the invisible game:
determine any wagering games different from the invisible game that correspond to the group identification code and that can be enabled on the electronic wagering gaming machine, wherein a first set of one or more wagering games different from the invisible game correspond to a first group identification code and a second different set of one or more wagering games different from the invisible game correspond to a second different group identification code;
responsive to at least one wagering game different from the invisible game corresponding to the group identification code and being enabled on the electronic wagering gaming machine, display, via the display device, a menu indicating the at least one wagering game and not indicating the invisible game;
establish a credit balance based at least in part on the read code;
receive, via the at least one input device, a selection of one of the indicated at least one wagering game;
place a wager on a play of the selected wagering game following receipt of an actuation of the wager button, the credit balance being decreasable by the wager;
randomly determine and display, via the display device, an outcome of said play of the selected wagering game; and
determine and display, via the display device, any award associated with the determined outcome, the credit balance being increasable by any award; and
following an actuation of the cashout button when the credit balance is greater than zero, initiate a payout associated with the credit balance.

2. The electronic wagering gaming machine of claim 1, wherein the plurality of instructions, when executed by the processor, cause the processor to:
responsive to the group identification code not corresponding to the invisible game or any other wagering games being enabled on the electronic wagering gaming machine, cause the ticket reader to reject the ticket.

3. The electronic wagering gaming machine of claim 1, wherein the plurality of instructions, when executed by the processor, cause the processor to determine whether the ticket is a valid ticket.

4. The electronic wagering gaming machine of claim 1, wherein the memory device stores a data structure thereon, the data structure indicating enabled wagering games and corresponding group identification codes, and wherein the plurality of instructions, when executed by the processor, cause the processor to determine the any wagering games that can be enabled on the electronic wagering gaming machine corresponding to the group identification code by utilizing data stored in the data structure.

5. The electronic wagering gaming machine of claim 1, wherein the code corresponds to the price of the ticket.

6. The electronic wagering gaming machine of claim 1, further comprising a network interface system comprising at least one network interface, wherein the plurality of instructions, when executed by the processor, cause the processor to operate with the network interface system to obtain software for a wagering game corresponding to the group identification code of the ticket.

7. The electronic wagering gaming machine of claim 1, wherein at least one of the at least one wagering game and the invisible game provides a guaranteed play session involving a predetermined number of plays.

8. The electronic wagering gaming machine of claim 1, further comprising a player loyalty device reader supported by the housing, wherein the plurality of instructions, when executed by the processor, cause the processor to:
receive, via the player loyalty device reader, player loyalty account information;
determine wagering game preferences associated with the player loyalty account information; and
determine whether there is a match between at least one of any wagering games corresponding to the group identification code and the wagering game preferences.

9. The electronic wagering gaming machine of claim 8, wherein the plurality of instructions, when executed by the processor, cause the processor to operate with the display device to, when there is a match between at least one of any wagering games corresponding to the group identification code and the wagering game preferences, display an indication of at least one matching wagering game.

10. The electronic wagering gaming machine of claim 1, wherein the at least one non-wager gaming related item includes a meal, a ticket to a performance, or a hotel room.

11. A method of operating an electronic wagering gaming machine, said method comprising:

receiving, at a ticket reader of the electronic wagering gaming machine, a ticket including a code;

reading, by the ticket reader, the code and causing a processor to determine, based on the read code, a group identification code;

causing the processor to determine whether the group identification code corresponds to an invisible game, wherein the invisible game is not presented in any menus for game play selection and wherein the invisible game is accessible via a discounted ticket that is obtained at a price below a value of the discounted ticket when used for wager gaming and that is obtained as part of a package that includes at least one non-wager gaming related item;

responsive to the group identification code corresponding to the invisible game, causing the processor to operate with a display device of the electronic wagering gaming machine to display a play of the invisible game including a randomly determined invisible game outcome;

responsive to the group identification code not corresponding to the invisible game:

causing the processor to determine any wagering games different from the invisible game that correspond to the group identification code and that can be enabled on the electronic wagering gaming machine, wherein a first set of one or more wagering games different from the invisible game correspond to a first group identification code and a second different set of one or more wagering games different from the invisible game correspond to a second different group identification code;

responsive to at least one wagering game different from the invisible game corresponding to the group identification code and being enabled on the electronic wagering gaming machine, causing the processor to operate with the display device to display a menu indicating the at least one wagering game and not indicating the invisible game;

causing the processor to establish a credit balance based at least in part on the read code;

receiving, by at least one input device, a selection of one of the indicated at least one wagering game;

causing the processor to place a wager on a play of the selected wagering game following receipt of an actuation of a wager button, the credit balance being decreasable by the wager;

causing the processor to randomly determine and operate with the display device to display an outcome of said play of the selected wagering game; and causing the processor to determine and operate with the display device to display any award associated with the determined outcome, the credit balance being increasable by any award;

responsive to a security switch attached to a door of the electronic wagering gaming machine detecting an opening of the door, suspending operation of the electronic wagering gaming machine; and following an actuation of a cashout button when the credit balance is greater than zero, causing the processor to initiate a payout associated with the credit balance.

12. The method of claim 11, further comprising: responsive to the group identification code not corresponding to the invisible game or any other wagering games being enabled on the electronic wagering gaming machine, rejecting the ticket.

13. The method of claim 11, further comprising causing the processor to determine whether the ticket is a valid ticket.

14. The method of claim 11, wherein the group identification code corresponds to the price of the ticket.

15. The method of claim 11, wherein at least one of the at least one wagering game and the invisible game provides a guaranteed play session involving a predetermined number of plays.

16. The method of claim 11, further comprising: if responsive to the group identification code not corresponding to the invisible game or any other wagering games that can be enabled on the electronic wagering gaming machine, receiving a new wagering game that corresponds to the group identification code.

17. The method of claim 16, further comprising receiving data associated with the new wagering game from another device.

18. An apparatus, comprising:

a housing including a door;

a security switch attached to the door of the housing and configured to detect an opening of the door;

a display device supported by the housing;

a reader supported by the housing and configured to receive a ticket and read a ticket code of the ticket for wager gaming;

a wager button supported by the housing;

a cashout button supported by the housing;

at least one input device supported by the housing;

a processor; and a memory device that stores a plurality of instructions that, when executed by the processor, cause the to:

determine at least one wagering game that can be enabled on the apparatus, the at least one wagering game corresponding to a group identification code associated with the ticket code, wherein a first set of at least one wagering game is associated with a first group identification code and a second different set of at least one wagering game is associated with a second different group identification code;

determine whether the group identification code corresponds to an invisible game, wherein the invisible game is different from the at least one wagering game, is not presented in any menus on the display device for game play selection, and is accessible via a discounted ticket that is obtained at a price below a value of the discounted ticket when used for wager gaming and that is obtained as part of a package that includes at least one non-wager gaming related item;

responsive to the group identification code corresponding to the invisible game, display, via the display device, a play of the invisible game including a randomly determined invisible game outcome;

responsive to the group identification code not corresponding to the invisible game:

display, via the display device, a menu on the display device indicating at least one of the at least one wagering game that can be enabled on the electronic wagering gaming machine and that corresponds to the group identification code and not indicating the invisible game;

establish a credit balance based at least in part on the read ticket code;

receive, via the at least one input device, a selection of one of the indicated at least one wagering game;

place a wager on a play of the selected wagering game following receipt of an actuation of the wager button, the credit balance being decreasable by the wager;

randomly determine and display, via the display device, an outcome of said play of said play of the selected wagering game; and determine and display, via the display device, any award associated with the determined outcome, the credit balance being increasable by any award; and following an actuation of the cashout button when the credit balance is greater than zero, initiate a payout associated with the credit balance.

19. The apparatus of claim 18, wherein the plurality of instructions, when executed by the processor, cause the processor to determine whether the ticket is a valid ticket.

20. The apparatus of claim 18, wherein the ticket code corresponds to the price of the ticket.

21. The apparatus of claim 18, wherein the memory device stores a data structure thereon, the data structure indicating enabled wagering games and corresponding group identification codes, and wherein the plurality of instructions, when executed by the processor, cause the processor to determine the at least one wagering game that can be enabled on the apparatus corresponding to the group identification code by utilizing data stored in the data structure.

22. The apparatus of claim 18, further comprising a network interface system comprising at least one network interface, wherein the plurality of instructions, when executed by the processor, cause the processor to operate with the network interface system to send a query to another device comprising a memory having a data structure stored thereon, the data structure indicating one or more wagering games that can be enabled on the apparatus and corresponding group identification codes.

* * * * *